US005491053A

United States Patent [19]

Barber et al.

[11] Patent Number: 5,491,053

[45] Date of Patent: Feb. 13, 1996

[54] CHROMOGENIC BLACK-AND-WHITE MOTION PICTURE FILM

[75] Inventors: Gary N. Barber, Penfield; Patricia R. Greco, Rochester; Mitchell J. Bogdanowicz, Spencerport; Elizabeth L. Kelly, Webster, all of N.Y.

[73] Assignee: Eastman Kodak Company, Rochester, N.Y.

[21] Appl. No.: 363,461

[22] Filed: Dec. 23, 1994

[51] Int. Cl.[6] ..... G03C 7/32; G03C 7/384; G03C 7/34; G03C 7/36

[52] U.S. Cl. ..... 430/549; 430/554; 430/402; 430/565

[58] Field of Search ..... 430/549, 554, 430/565, 402, 505

[56] References Cited

U.S. PATENT DOCUMENTS

| | | | |
|---|---|---|---|
| 2,186,736 | 1/1940 | Schneider et al. | 95/6 |
| 2,428,054 | 9/1947 | Vittum et al. | 95/2 |
| 2,592,514 | 4/1952 | Harsh | 95/2 |
| 2,689,180 | 9/1954 | Friedman | 95/2 |
| 3,227,554 | 1/1966 | Barr et al. | 96/55 |
| 3,253,913 | 5/1966 | Smith et al. | 96/1 |
| 3,734,735 | 5/1973 | Bories | 96/55 |
| 3,941,599 | 3/1976 | Bussato et al. | 96/66.3 |
| 4,042,394 | 8/1977 | Smith, Jr. et al. | 96/56 |
| 4,243,747 | 1/1981 | Nakamura et al. | 430/551 |
| 4,348,474 | 9/1982 | Scheerer et al. | 430/382 |
| 4,729,943 | 3/1988 | Pfaff et al. | 430/362 |
| 4,868,099 | 9/1989 | Renner et al. | 430/554 |
| 4,914,013 | 4/1990 | Ikesu et al. | 430/554 |
| 5,110,718 | 5/1992 | Tanji et al. | 430/554 |
| 5,262,284 | 11/1993 | Lau et al. | 430/359 |
| 5,262,286 | 11/1993 | Bacilek et al. | 430/362 |
| 5,270,158 | 12/1993 | Nakatsugawa et al. | 430/554 |
| 5,362,616 | 11/1994 | Edwards et al. | 430/356 |

FOREIGN PATENT DOCUMENTS

| | | | |
|---|---|---|---|
| 93/12465 | 6/1993 | WIPO | G03C 7/30 |

OTHER PUBLICATIONS

EP 459 331, dated Dec. 4, 1991—Abstract.

*Primary Examiner*—Richard L. Schilling
*Attorney, Agent, or Firm*—Paul A. Leipold

[57] ABSTRACT

The invention relates to a photographic element comprising a Formula I class yellow coupler comprising

I wherein $R_1$ represents a substituent;

X is hydrogen or a coupling-off group;

Y represents an aryl group or a heterocyclic group;

a Formula II class cyan coupler comprising

II wherein $R_2$ represents a substituent;

$R_3$ represents a substituent;

X represents a hydrogen or a coupling-off group;

m is from 1–3; and a Formula III class magenta coupler comprising

III wherein $R_4$ is a substituent;

(Abstract continued on next page.)

$R_5$ is a substituent;

X is hydrogen or a coupling-off group;

and which provides a relative fixed upper scale contrast between 1.1 and 1.8.

An alternative form of the invention relates to a photographic element comprising a Formula I class yellow coupler comprising

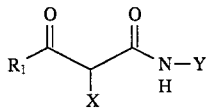

I wherein $R_1$ represents a substituent;

X is hydrogen or a coupling-off group;

Y represents an aryl group or a heterocyclic group;

a Formula IV class cyan coupler comprising

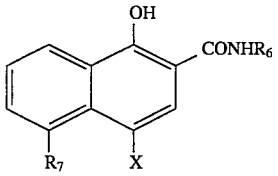

IV wherein $R_6$ represents a ballast substituent;

$R_7$ represents a substituent;

X represents a hydrogen or a coupling-off group;

a Formula III class magenta coupler comprising

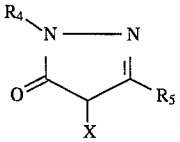

III wherein $R_4$ is a substituent;

$R_5$ is a substituent;

X is hydrogen or a coupling-off group;

and which provides a relative fixed upper scale contrast between 1.9 and 2.1.

13 Claims, 22 Drawing Sheets

CHROMOGENIC BLACK-AND-WHITE MOTION PICTURE FILM

FIELD OF THE INVENTION

This invention relates to the formation of a motion picture system which produces black-and-white images using a combination of cyan, magenta, and yellow dyes in a single layer. The dyes are formed during a color development step from a mixture of cyan, magenta, and yellow dye-forming couplers which, when allowed to react with oxidized color developer, form a neutral image.

BACKGROUND OF THE INVENTION

Black-and-white images formed in a photographic process are generally produced by developing silver halide in a black-and-white developer to form a silver image. A black-and-white developer, such as hydroquinone, is commonly used to reduce the exposed silver halide to silver metal. The undeveloped silver halide is removed from the print by 'fixing' with aqueous sodium thiosulfate. The silver metal remaining in the print represents the image.

In the photographic industry, a motion picture film processing laboratory who wishes to produce both black-and-white and color pictures must have separate processing systems; one for color and one for black-and-white, as the two systems are not compatible. It would, therefore, be advantageous for the processing laboratory to have one process capable of producing either black-and-white or color pictures.

U.S. Pat. No. 4,348,474—Scheerer discloses a system wherein black-and-white images are formed by the use of one emulsion that is treated with three sensitizing dyes.

U.S. Pat. No. 2,186,736—Schneider discloses the use of several color components in one layer for a black-and-white image formation.

U.S. Pat. No. 2,592,514—Harsh discloses a color film in which couplers forming more than one color are present in the same layer of the color film.

There have been commercialized products that have formed black-and-white images by the use of pan sensitized emulsions which contain three spectral sensitizing dyes, color dye-forming couplers and one emulsion. These pan-sensitive emulsions are sometimes coated in a fast and a slow layer to form images after exposure and development of the couplers. While the above products are somewhat successful, they do not achieve a neutral image. Additionally, the tone reproduction of such materials is severely limited by the contrast range of the emulsion.

U.S. Pat. No. 5,362,616—Edwards et al. discloses a system for forming black-and-white images on photographic paper through the use of color processing. The system utilizes a spectrally sensitized silver chloride emulsion containing one spectral sensitizing dye that is combined in the same layer with a mixture of cyan, magenta, and yellow dye-forming couplers. In a preferred form there is one silver chloride emulsion layer sensitized to blue light, one silver chloride emulsion layer sensitized to green light, and one silver chloride emulsion layer sensitized to red light, with each emulsion layer containing a mixture of the cyan, magenta, and yellow dye-forming couplers.

Problem To Be Solved By The Invention

There remains a need for a motion picture film that may be processed in the color motion picture development system normally referred to as Process ECP-2B which will produce black-and-white pictures. The need for silver-based black-and-white motion picture film to be processed in a black-and-white process is a disadvantage in that the primary motion picture processing systems are set up to handle color couplers. There would be an advantage if a film that produces black-and-white images was available that could be utilized in the existing color processing systems. Furthermore, there is a disadvantage with mixing silver halide-based and color coupler-based film in the same production in that focusing problems are often encountered due to incompatibility of film types. There would be an advantage if a film that produces black-and-white images from color couplers was available which could be mixed in the same production with film that produces color images from color couplers.

SUMMARY OF THE INVENTION

An object of the invention is to provide a chromogenic black-and-white motion picture film that utilizes the conventional processing system for color motion pictures to produce black-and-white images.

Another object of the invention is to provide a black-and-white motion picture film that is low in cost and of high quality.

These and other objects of the invention are generally accomplished by a photographic element comprising a Formula I class yellow coupler comprising

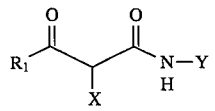

I wherein $R_1$ represents a substituent;

X is hydrogen or a coupling-off group;

Y represents an aryl group or a heterocyclic group;

a Formula II class cyan coupler comprising

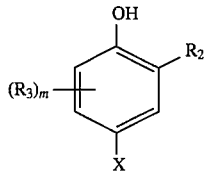

II wherein $R_2$ represents a substituent;

$R_3$ represents a substituent;

X represents a hydrogen or a coupling-off group;

m is from 1–3; and a Formula III class magenta coupler comprising

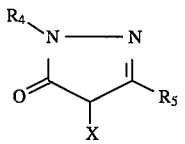

III wherein $R_4$ is a substituent;

$R_5$ is a substituent;

X is hydrogen or a coupling-off group;

and which provides a relative fixed upper scale contrast between about 1.1 and 1.8.

In an alternative form of the invention there is formed a photographic element comprising a Formula I class yellow coupler comprising

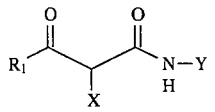

I wherein $R_1$ represents a substituent;

X is hydrogen or a coupling-off group;

Y represents an aryl group or a heterocyclic group;

a Formula IV class cyan coupler comprising

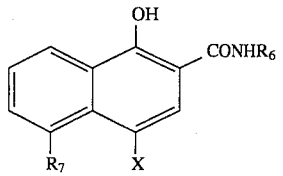

IV wherein $R_6$ represents a ballast substituent;

$R_7$ represents a substituent;

X represents a hydrogen or a coupling-off group;

a Formula III class magenta coupler comprising

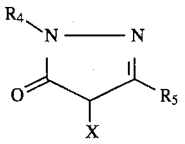

III wherein $R_4$ is a substituent;

$R_5$ is a substituent;

X is hydrogen or a coupling-off group;

and which provides a relative fixed upper scale contrast above about 1.9.

Advantageous Effect of the Invention

The invention has numerous advantages over the prior processes. The invention of a motion picture film utilizing color couplers to form a black-and-white image allows use of existing motion picture color processing systems. Therefore, a parallel black-and-white processing system for silver halide black-and-white development is not needed. Further, as the silver does not form the image, there is a cost savings in materials utilized in forming the motion picture film, as well as in the processing of it. Further, the system of the invention allows the formation of black-and-white images formed from color couplers in layers that have silver halide of different composition. Furthermore, the system of the invention allows lightness ratios in a scene to be reproduced more accurately than what silver halide-based black-and-white films can currently achieve. Another advantage is that tone scale can be changed through contrast manipulation in the printing stage rather than the processing stage as is currently done, by regulating the ratio of the red, green, and blue light used in the printing stage. This would give color timers the flexibility to make scene-to-scene contrast changes in the printing stage similar to the way they currently make scene-to-scene color timing. This is not possible currently. Still another advantage is that this system overcomes the projection problems associated with combining conventional silver halide-based and color coupler-based films in a single production. Still another advantage of this .invention is that black-and-white images can be generated by exposure of the motion picture film through either a black-and-white or color origination negative film.

DETAILED DESCRIPTION OF THE INVENTION

Figure 1:
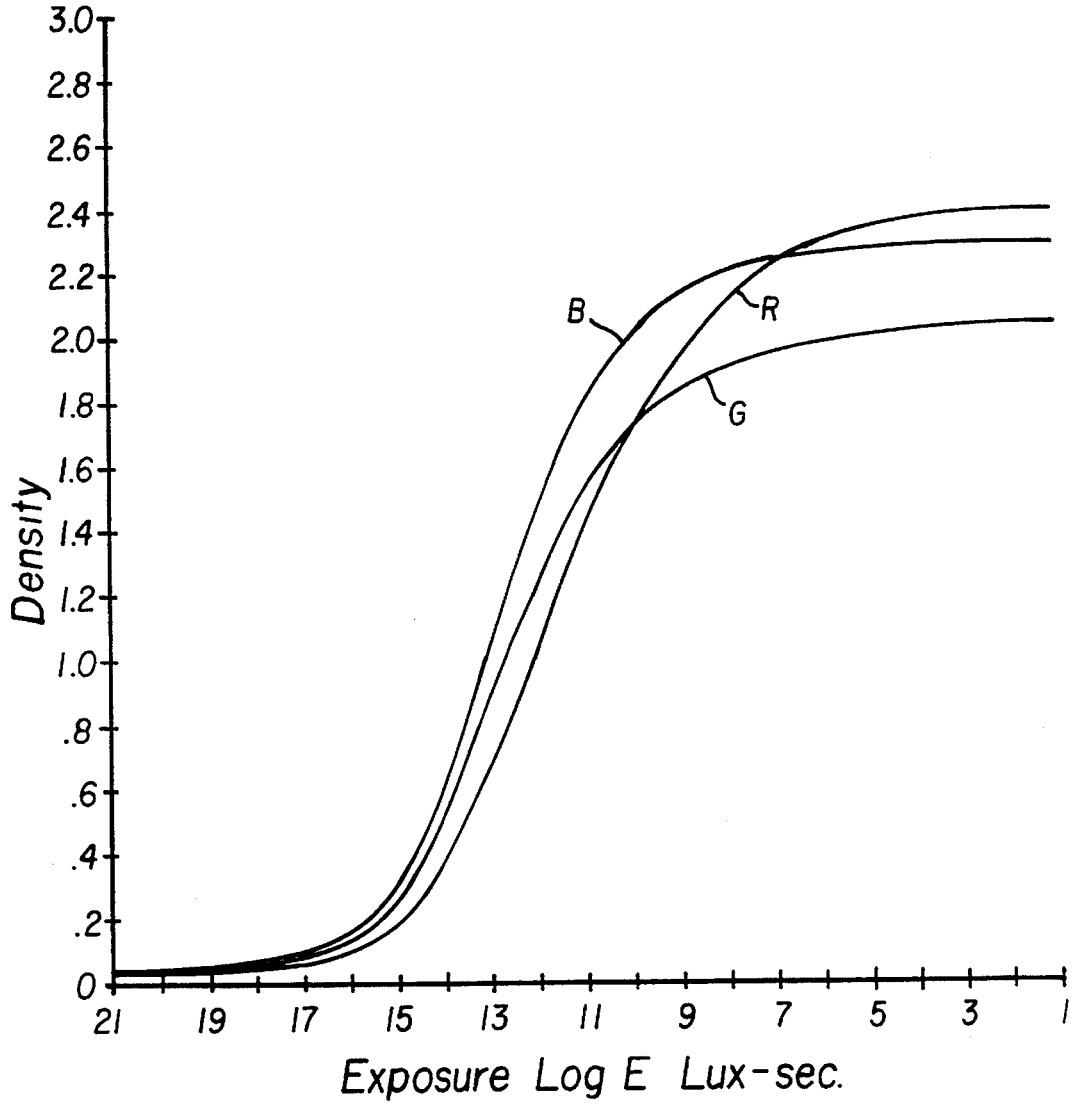
FIGS. 1–22 are red, green, and blue sensitometric curves for the photographic elements of the examples.

When the formation of black-and-white images was attempted utilizing conventional motion picture emulsions, color couplers, and processing, it was found that a neutral image could not be formed due to the difference in rate of formation of oxidized developer from development of silver halide emulsions of different composition and the rate of coupling of oxidized developer with the color couplers. Unlike color paper, the emulsions of the cyan, magenta, and yellow layers of a motion picture film do not have the same chemical composition. Therefore, it was necessary to utilize different color couplers to ensure that the reactivity of the particular emulsion compositions and coupler compositions was balanced to produce a neutral image. Surprisingly, it has been found that while a set of couplers may be utilized individually in separate layers to form a satisfactory color image, the same couplers cannot be blended within the same layer and combined with a spectrally sensitized silver halide emulsion to form a neutral image. Therefore, the selection of couplers must be determined from a co-optimization based on their coupling reactivities in the motion picture development system.

It is known to utilize in the formation of a color motion picture system the yellow coupler K, the magenta coupler H, and the cyan coupler G.

K

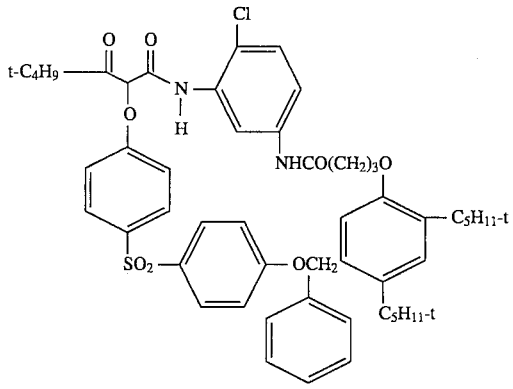

H

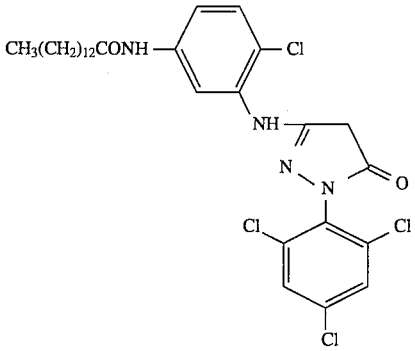

-continued

G

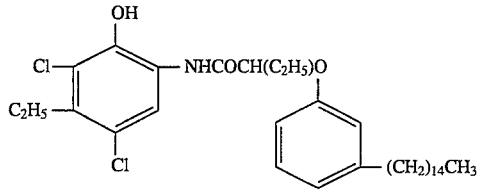

The conventional emulsions utilized in color motion picture film are silver chlorobromide emulsions in the magenta and cyan layers, while the yellow layer is substantially a 100 percent silver chloride emulsion. Using the technique of the present invention, it has been found possible to utilize the same emulsions, thereby simplifying the development of a chromogenic black-and-white motion picture film and allowing the developing process to remain the same.

It has been found that when a photographic element comprising a Formula I class yellow coupler and a cyan coupler of Formula II class are utilized in a motion picture film for forming black-and-white images from color couplers then a Formula III magenta coupler providing a relative fixed upper scale contrast between about 1.1 and 1.8 should be utilized. The test for determining relative fixed upper scale contrast is set forth in Example 6 below, and relative fixed upper scale contrast values referred to herein are derived utilizing that test. There is a need to utilize the relative fixed upper scale contrast metric to eliminate the impact of silver halide developability differences in order to focus on the magenta coupler reactivity properties that constitute the invention.

It has also been found that when a photographic element comprising a yellow coupler of the Formula I class, utilized in combination with a cyan coupler of the Formula IV class that a magenta coupler of the Formula III class having a relative fixed upper contrast above about 1.9 should be utilized. Preferably, it has been found that the magenta coupler of the Formula III class has a relative fixed upper scale contrast between about 1.9 and 2.1.

In the motion picture film of the invention, it is preferred that the yellow emulsion be a high chloride emulsion. Generally the emulsion is between about 99 and 95 percent chloride with the remainder being bromide. In a preferred form, the emulsion is 99 percent chloride and about 1 percent bromide. For the magenta and cyan layers, a silver chlorobromide emulsion is utilized in which the chloride is present in an amount between about 65 and 85 percent with the remainder silver bromide. It is preferred that the magenta and cyan emulsions have about 75 percent chloride for best formation of a neutral black-and-white image. The emulsions are generally cubic in a size between about 0.1 and 0.8 microns. For the blue sensitive layer a grain size of about 0.4 to 0.8 microns when the red sensitive and green sensitive layers have a grain size of 0.1 to 0.3 microns is preferred to maintain a speed separation between the blue sensitive layer and the other layers to achieve accurate color balance.

The Formula I class couplers may be defined as

I

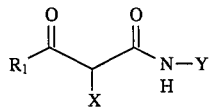

wherein $R_1$ represents a substituent; X is hydrogen or a coupling-off group; Y represents an aryl group or a heterocyclic group. Preferred is when $R_1$ represents an aryl or tertiary alkyl group.

The Formula II class cyan couplers may be defined as

II

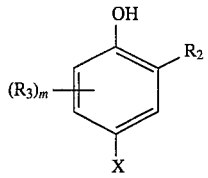

wherein $R_2$ represents a substituent (preferably a carbamoyl, ureido, or carbonamido group); $R_3$ represents a substituent (preferably individually selected from halogens, alkyl, and carbonamido groups); X represents a hydrogen or a coupling-off group; and m is from 1–3.

The Formula III class magenta coupler comprising

III

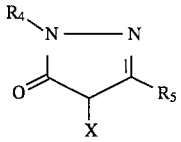

wherein $R_4$ is a substituent (preferably an aryl group); $R_5$ is a substituent (preferably an anilino; carbonamido, ureido, carbomoyl, alkoxy, aryloxycarbonyl, alkoxycarbonyl, or N-heterocyclic group); X is hydrogen or a coupling-off group.

The Formula IV class cyan couplers may be defined as

IV

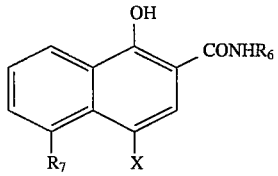

wherein $R_6$ represents a ballast substituent, preferably an alkyl or aryl group of 8 to 40 carbon atoms; $R_7$ represents a substituent (preferably a hydrogen, carbonamido or sulphonamido group); X represents a hydrogen or a coupling-off group.

To control the migration of various components, it may be desirable to include a high molecular weight hydrophobe or "ballast" group in the component molecule of the couplers of the invention. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also De further substituted. Alternatively, the molecular can be made immobile by attachment to a polymeric backbone.

It is understood that reference to a substituent by the identification of a group containing a substitutable hydrogen (e.g., alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues, and bridged hydrocarbon compound residues.

Couplers can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Representative classes of such coupling-off groups include, for example, chloro, alkoxy, aryloxy, heterooxy, sulfonyloxy, acyloxy, acyl, N-containing heterocyclic groups (such as pyrazolyl, imidazoyl, triazoyl, benzotriazoyl, oxazolidinedionoyl, etc.), imides (such as succinimido and hydantoinyl), sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728; 1,531,927; 1,533,039; 2,006,755A; and 2,017,704A. Preferred coupling-off groups are chloro, aryloxy, and N-containing heterocyclic groups.

Process ECP-2B is the developing process generally used for the black-and-white films of the invention and is described in the examples which follow.

The following examples are representative of the invention and are not intended to be exhaustive of the possibilities.

EXAMPLE 1: (Control)

This example demonstrates that use of the coupler dispersion utilized in a chromogenic black-and-white paper of U.S. Pat. No. 5,362,616 does not provide a neutral image when elements containing this dispersion and a red sensitized silver chlorobromide (99:1) emulsion or a red sensitized silver chlorobromide (75:25) emulsion are processed in Process ECP-2B:

The oil phase is composed of a mixture of:

| | |
|---|---|
| Cyan Coupler A | 68.8 g |
| Magenta Coupler B | 43.7 g |
| Yellow Coupler C | 84.9 g |
| Stabilizer D | 21.5 g |
| Coupler Solvent E | 86.2 g |
| Auxiliary Solvent F | 76.3 g |

The aqueous phase of the dispersion is composed of a mixture of:

| | |
|---|---|
| Gelatin | 145.8 g |
| Alkanol-XC ™ Surfactant (Dupont) | 14.6 g |
| Water | 1458.2 g |
| Total | 2000.0 g |

Procedure:

1) The materials used in the oil phase were combined and heated to 135° C. with stirring until dissolution occurred.

2) After dissolution occurred, the hot oil phase was quickly added to the preheated (73° C.) aqueous phase mixture with stirring.

3) The mixture was then passed through a homogenizer, collected, then rapidly chilled until the dispersion was set.

4) This 3-coupler dispersion was then mixed with additional gelatin, water, and silver halide and coated on a gelatin subbed acetate film support with Rem Jet backing in a single layer format with the following structure:

| Coating 1 |
|---|
| Protective Overcoat Layer: |
| Poly(dimethyl siloxane) 65.9 mg/m$^2$ |
| Poly(dimethyl methacrylate) beads, 5.0 mg/m$^2$ |
| Gelatin, 1001 mg/m$^2$ |
| Spreading aids |
| Gel hardener |
| Emulsion Layer: |
| Aurous sulfide sensitized silver chlorobromide (99:1) emulsion, 0.38 micron, spectrally sensitized with a red dye, 732.0 mg/m$^2$ |
| Gelatin, 3014 mg/m$^2$ |
| Cyan Coupler A, 645.8 mg/m$^2$ |
| Magenta Coupler B, 410.1 mg/m$^2$ |
| Yellow Coupler C, 797.6 mg/m$^2$ |
| Gelatin Sub: |
| Gelatin, 4887 mg/m$^2$ |
| Support: |
| Transparent Acetate Support with Rem Jet Backing. Rem jet is a black-pigmented, nongelatin layer on the back of the film base which provides antihalation and antistatic properties. |

The element was exposed for 1/500 second by means of a 3000 degree K Tungsten light source through a 0–3 neutral density step tablet, a heat-absorbing filter, and a filter designed to represent a motion picture color negative film. After exposure, the element was processed through Process ECP-2B with the exception that those steps specific to sound track development were omitted. The process consists of a prebath (10"), water rinse (20"), color developer (3'), stop bath (40"), first wash (40"), first fix (40"), second wash (40"), bleach (1'), third wash ( 40") , second fix (40") , fourth wash (1'), final rinse (10"), and then drying with hot air.

The ECP-2B Prebath consists of:

| | |
|---|---|
| Water | 800 mL |
| Borax (decahydrate) | 20.0 g |
| Sodium sulfate (anhydrous) | 100.0 g |
| Sodium hydroxide | 1.0 g |
| Water to make | 1 liter |

pH @ 80° F. is 9.25 +/− 0.10

The ECP-2B Color Developer consists of:

| | |
|---|---|
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0 N) | 0.62 mL |
| Water to make | 1 liter |

pH @ 80° F. is 10.53 +/− 0.05

The ECP-2B Stop Bath consists of:

| | |
|---|---|
| Water | 900 mL |
| Sulfuric acid (7.0 N) | 50 mL |
| Water to make | 1 liter |

pH @ 80° F. is 0.90

The ECP-2B Fixer consists of:

| | |
|---|---|
| Water | 800 mL |
| Ammonium thiosulfate (58.0% solution) | 100.0 mL |
| Sodium bisulfite (anhydrous) | 13.0 g |
| Water to make | 1 liter |

pH @ 80° F. is 5.00 +/− 0.15

The ECP-2B Ferricyanide Bleach consists of:

| | |
|---|---|
| Water | 900 mL |
| Potassium ferricyanide | 30.0 g |
| Sodium bromide (anhydrous) | 17.0 g |
| Water to make | 1 liter |

pH @ 80° F. is 6.50 +/− 0.05

The Final Rinse solution consists of:

| | |
|---|---|
| Water | 900 mL |
| Kodak Photo-Flo 200 ™ Solution (Photo-Flo 200 is a surfactant) | 3.0 mL |
| Water to make | 1 liter |

Processing of the exposed elements is done with the color developing solution adjusted to 98° F. The stopping, fixing, bleaching, washing, and final rinsing solution temperatures are adjusted to 80° F.

The optical density due to dye formation was then measured on a densitometer using filters in the densitometer appropriate to the intended use of the photographic element. Dye Density was then graphed vs. log(exposure) to form the so-called characteristic R,G,B curves of the photographic element. FIG. 1 shows that the R,G,B curves are not close to being superimposable, and visual inspection of the element showed it to have a reddish hue.

Figure 2:
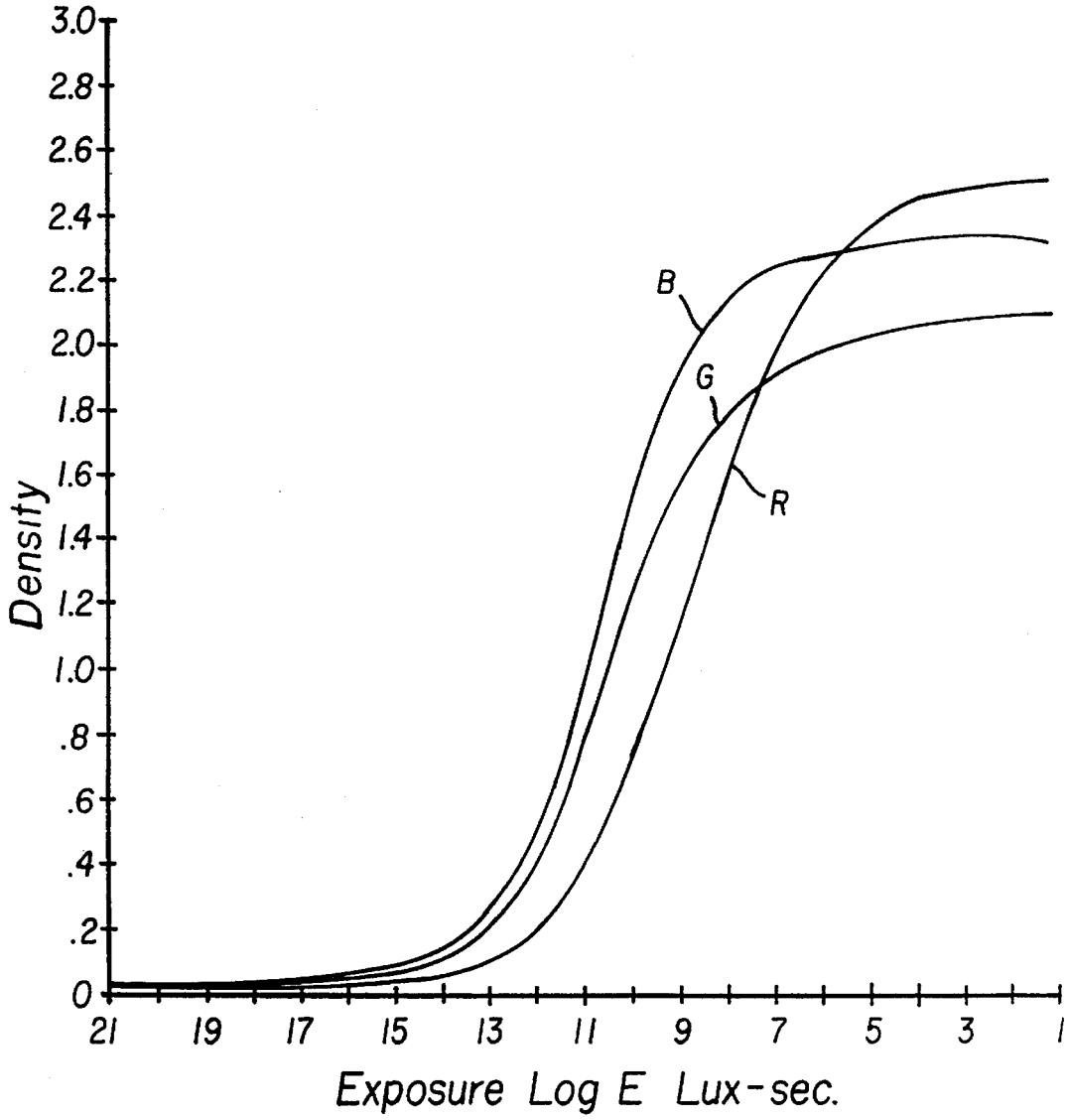

Another photographic element was prepared in a similar manner except that the silver chlorobromide (99:1) emulsion was replaced with a sulfur and gold sensitized silver chlorobromide (75:25), 0.15 micron, spectrally sensitized with a red sensitizing dye, 732.0 mg/m$^2$. This element was exposed, processed, and its optical density due to dye formation was measured as described above. FIG. 2 shows the graph of the R,G,B characteristic curves. The speed separation between the B curve having highest sensitivity and the R curve having lowest sensitivity at a density of 1.0 is greater than that in FIG. 1. This clearly shows that photographic elements containing the coupler dispersion utilized in a chromogenic black-and-white paper and a silver chlorobromide (99:1) or a silver chlorobromide (75:25) emulsion that is processed in Process ECP-2B will not provide neutral images. Furthermore, the element containing a silver chlorobromide emulsion with a higher level of bromide gives an image which is even less neutral than an element containing a silver chlorobromide emulsion which is very low in bromide content.

EXAMPLE 2: (Control)

This example demonstrates that a dispersion formulation containing cyan coupler G, magenta coupler H, and yellow coupler C provides an essentially neutral image when an element containing this dispersion and a blue sensitized silver chlorobromide (99:1) emulsion is processed in Process ECP-2B but not when an element containing the same dispersion and a red spectrally sensitized silver chlorobromide (75:25) is similarly prepared and processed. This also represents a case of mismatched coupler reactivities, i.e., the magenta H and yellow C couplers are more reactive than the cyan coupler G:

The oil phase of the 3-coupler dispersion is composed of a mixture of:

| | |
|---|---|
| Cyan Coupler G | 75.2 g |
| Magenta Coupler H | 31.2 g |
| Yellow Coupler C | 64.4 g |
| Coupler Solvent E | 68.8 g |
| Auxiliary Solvent I | 320.0 g |

The aqueous phase of the dispersion is composed of a mixture of:

| | |
|---|---|
| Gelatin | 130.0 g |
| Alkanol-XC Surfactant | 12.0 g |
| Water | 1298.4 g |
| Total | 2000.0 g |

Procedure:

1) The materials used in the oil phase were combined and heated to 65° C. with stirring until dissolution occurred.

2) After dissolution occurred, the hot oil phase was quickly added to the preheated (48° C.) aqueous phase mixture with stirring.

3) The mixture was then passed through a colloid mill, collected, auxiliary solvent I was removed under reduced pressure, and distilled water was added to the mixture to make up for the loss in weight of auxiliary solvent I.

4) The mixture was stirred and then rapidly chilled until the dispersion was set.

5) This 3-coupler dispersion was then mixed with additional gelatin, water, and silver halide and coated on a gelatin subbed acetate film support with Rem Jet backing in a single layer format with the following structure:

| Coating 2 |
|---|
| Protective Overcoat Layer: |
| Poly(dimethyl siloxane), 65.9 mg/m$^2$ |
| Poly(dimethyl methacrylate) beads, 5.0 mg/m$^2$ |
| Gelatin, 1001 mg/m$^2$ |
| Spreading aids |
| Gel hardener |
| Emulsion Layer: |
| Sulfur and gold sensitized silver chlorobromide (99:1) emulsion, 0.58 micron, spectrally sensitized with a blue dye, 818.1 mg/m$^2$. |
| Gelatin, 3014 mg/m$^2$ |
| Cyan Coupler G, 645.8 mg/m$^2$ |
| Magenta Coupler H, 267.9 mg/m$^2$ |
| Yellow Coupler C, 553.1 mg/m$^2$ |
| Gelatin Sub: |
| Gelatin, 4887 mg/m$^2$ |
| Support: |
| Transparent Acetate Support with Rem Jet Backing |

Figure 3:
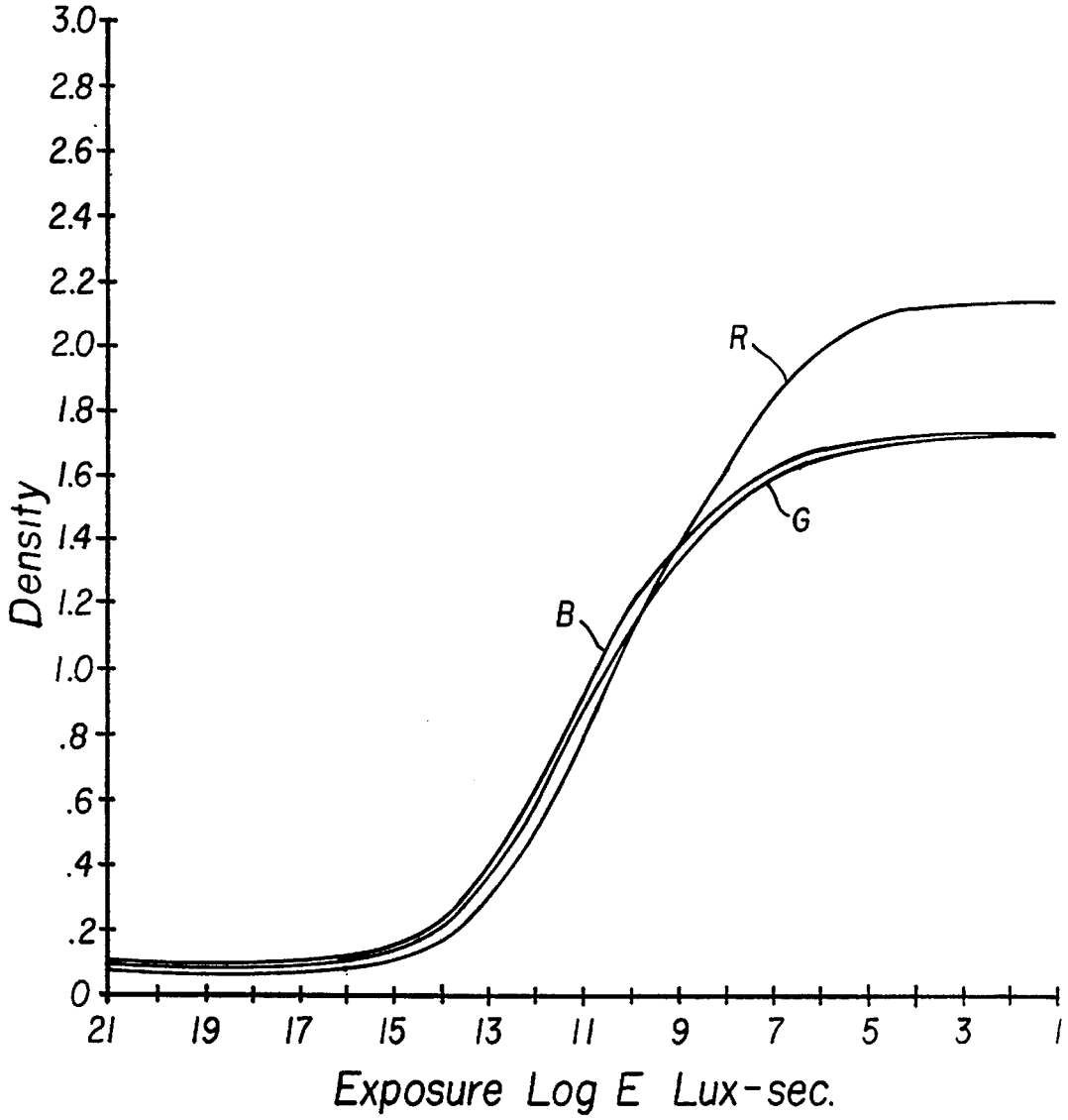

The element was exposed, processed, and the optical density due to dye formation was measured as described in Example 1. The characteristic curves shown in FIG. 3 are nearly superimposable in the low and middle exposure region and visual inspection of the element showed it to be neutral even in the highest density region.

Figure 4:
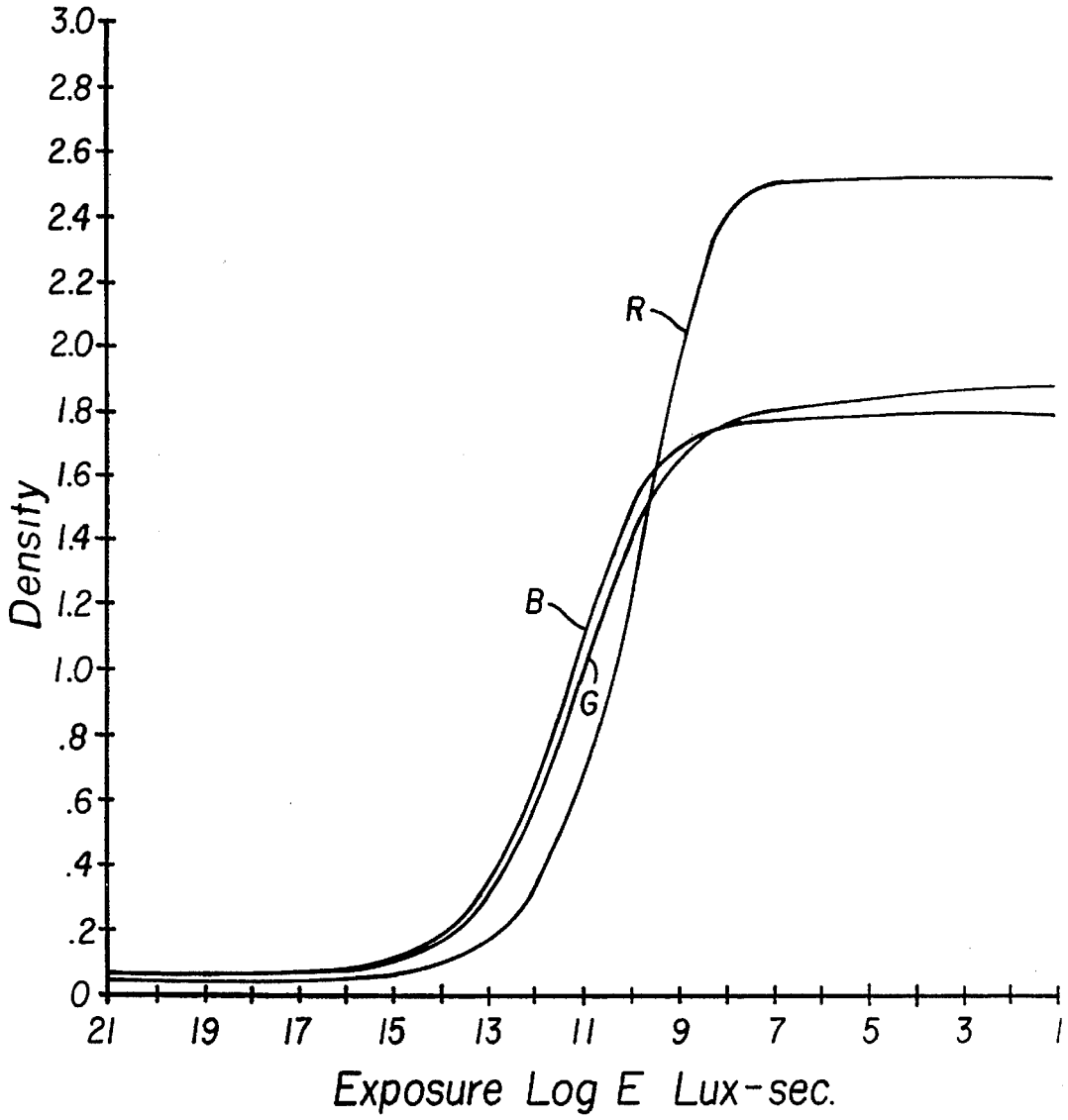

Another photographic element was prepared in a similar manner except that the blue spectrally sensitized sulfur and gold sensitized silver chlorobromide (99:1) emulsion was replaced by a red spectrally sensitized sulfur and gold chemically sensitized silver chlorobromide (75/25) emulsion, 0.15 micron, 818.1 mg/m$^2$. This element was exposed, processed, and its optical density due to dye formation was measured as described above. FIG. 4 shows the graph of the R,G,B characteristic curves. It clearly shows that the speed separation between the B curve having highest sensitivity at a density of 1.0 and the R curve having lowest sensitivity at a density of 1.0 is greater than the speed separation between the B and R curves at a density of 1.0 in FIG. 3. While it is possible to get a nearly neutral image with this dispersion and a silver chlorobromide (99:1) emulsion in an element processed in Process ECP-2B, it is not possible to get a neutral image with this dispersion and a silver chlorobromide (75:25) emulsion in an element processed in Process ECP-2B.

EXAMPLE 3: (Control)

This example demonstrates that a dispersion formulation containing cyan coupler G, magenta coupler J, and yellow coupler K does not provide a neutral image when an element containing this dispersion and a red spectrally sensitized, sulfur and gold chemically sensitized silver chlorobromide (75:25) emulsion, is processed in Process ECP-2B. This also represents a case of mismatched coupler reactivities, i.e., the magenta coupler J is less reactive than the cyan G or yellow K couplers:

The oil phase of the 3-coupler dispersion is composed of a mixture of:

| | |
|---|---|
| Cyan Coupler G | 49.7 g |
| Magenta Coupler J | 34.3 g |
| Yellow Coupler K | 74.3 g |
| Coupler Solvent E | 81.7 g |
| Auxiliary Solvent I | 320.0 g |

The aqueous phase of the dispersion is composed of a mixture of:

| | |
|---|---|
| Gelatin | 130.0 g |
| Alkanol-XC Surfactant | 12.0 g |
| Water | 1298.0 g |
| Total | 2000.0 g |

The procedure for making this dispersion is identical to that described in Example 2. This dispersion was coated in a single layer format with the following structure:

| Coating 3 |
|---|
| Protective Overcoat Layer: |
| Poly(dimethyl siloxane), 65.9 mg/m$^2$ |
| Poly(dimethyl methacrylate) beads, 5.0 mg/m$^2$ |
| Gelatin, 1001 mg/m$^2$ |
| Spreading aids |
| Gel hardener |
| Emulsion Layer: |
| Sulfur and gold sensitized silver chlorobromide (75:25) emulsion, 0.15 micron, spectrally sensitized with a red dye, 818.1 mg/m$^2$. |
| Gelatin, 3014 mg/m$^2$ |
| Cyan Coupler G, 645.8 mg/m$^2$ |
| Magenta Coupler J, 445.7 mg/m$^2$ |
| Yellow Coupler K, 965.5 mg/m$^2$ |
| Gelatin Sub: |
| Gelatin, 4887 mg/m$^2$ |
| Support: |
| Transparent Acetate Support with Rem Jet Backing |

Figure 5:
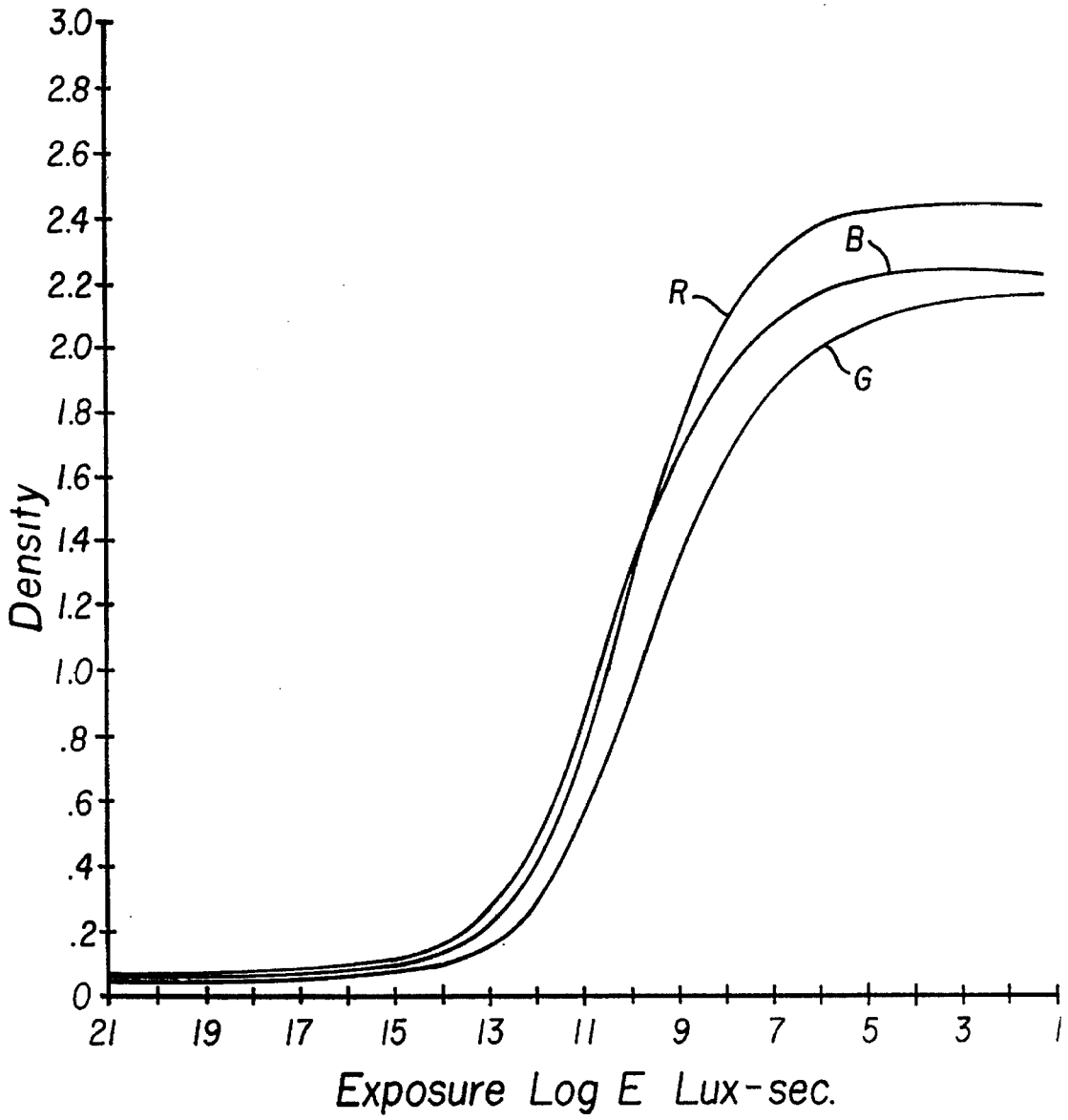

The element was exposed, processed, and the optical density due to dye formation was measured as described in Example 1. The characteristic curves are shown in FIG. 5. It is evident from this graph that the speed separation at a density of 1.0 is too large between the B curve of highest sensitivity and the G curve of lowest sensitivity to give a neutral image.

EXAMPLE 4: (Invention)

This example demonstrates that a dispersion formulation containing cyan coupler G, magneta coupler L, and yellow coupler K provides essentially neutral images when elements containing this dispersion and a blue sensitized silver chlorobromide (99:1) emulsion or a red or a green spectrally sensitized silver chlorobromide (75:25) emulsion are processed in Process ECP-2B. This represents a case where the reactivities of the cyan G (Formula II), magenta L (Formula III), and yellow K (Formula I) couplers are matched:

The oil phase of the 3-coupler dispersion is composed of a mixture of:

| | |
|---|---|
| Cyan Coupler G | 48.2 g |
| Magenta Coupler L | 30.9 g |
| Yellow Coupler K | 79.2 g |
| Coupler Solvent E | 81.7 g |
| Auxiliary Solvent I | 320.0 g |

The aqueous phase of the dispersion is composed of a mixture of:

| | |
|---|---|
| Gelatin | 130.0 g |
| Alkanol-XC Surfactant | 12.0 g |
| Water | 1298.0 g |
| Total | 2000.0 g |

The procedure for making this dispersion is identical to that described in Example 2. This dispersion was coated in a single layer format with the following structure:

| Coating 4 |
|---|
| Protective Overcoat Layer: |
| Poly(dimethyl siloxane), 65.9 mg/m$^2$ |
| Poly(dimethyl methacrylate) beads, 5.0 mg/m$^2$ |
| Gelatin, 1001 mg/m$^2$ |
| Spreading aids |
| Gel hardener |
| Emulsion Layer: |
| Sulfur and gold sensitized silver chlorobromide (99:1) emulsion, 0.58 micron, spectrally sensitized with a blue dye, 818.1 mg/m$^2$. |
| Gelatin, 3229 mg/m$^2$ |
| Cyan Coupler G, 645.8 mg/m$^2$ |
| Magenta Coupler L, 414.0 mg/m$^2$ |
| Yellow Coupler K, 1061 mg/m$^2$ |
| Gelatin Sub: |
| Gelatin, 4887 mg/m$^2$ |
| Support: |
| Transparent Acetate Support with Rem Jet Backing |

Figure 6:
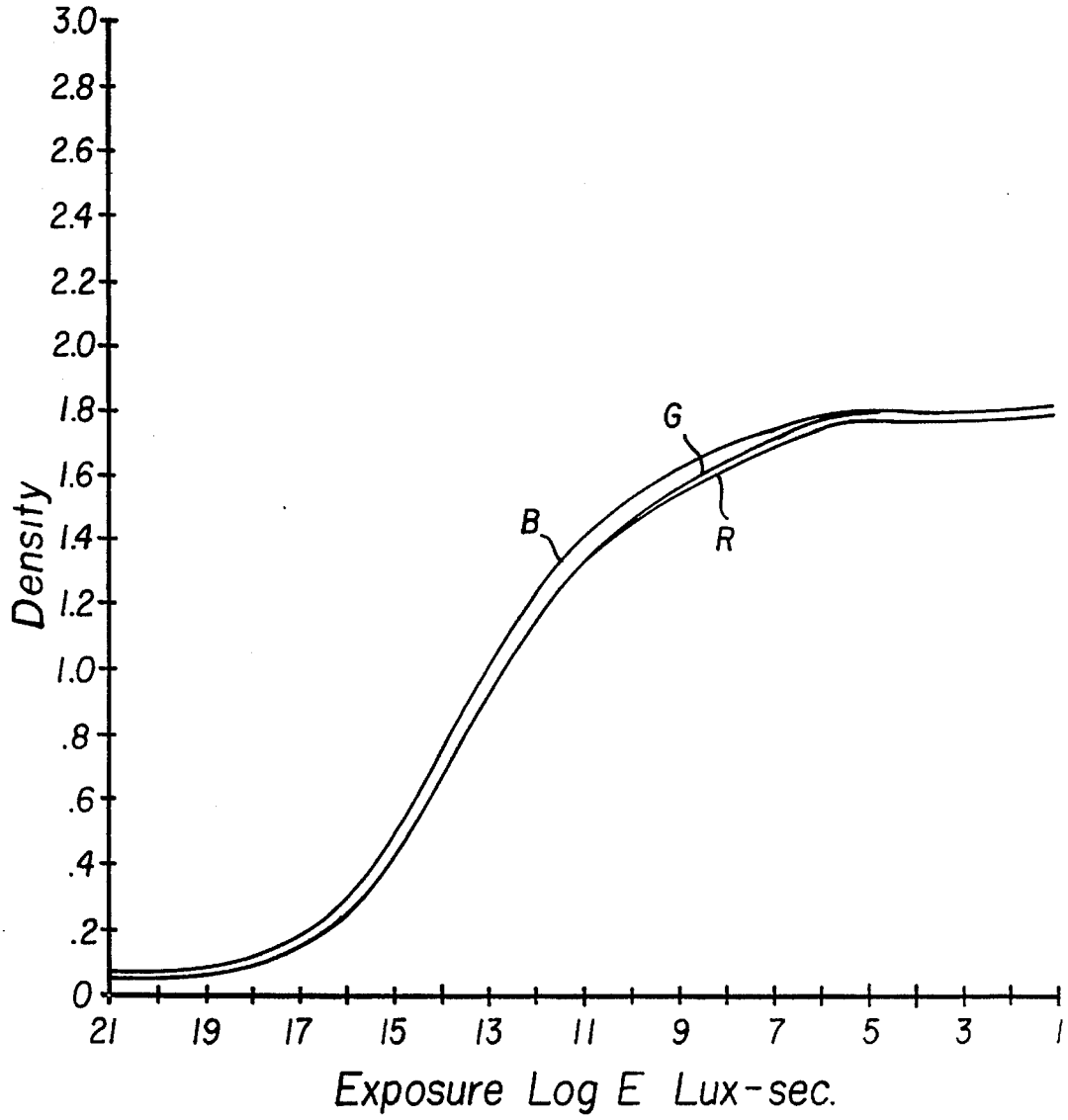
Figure 7:
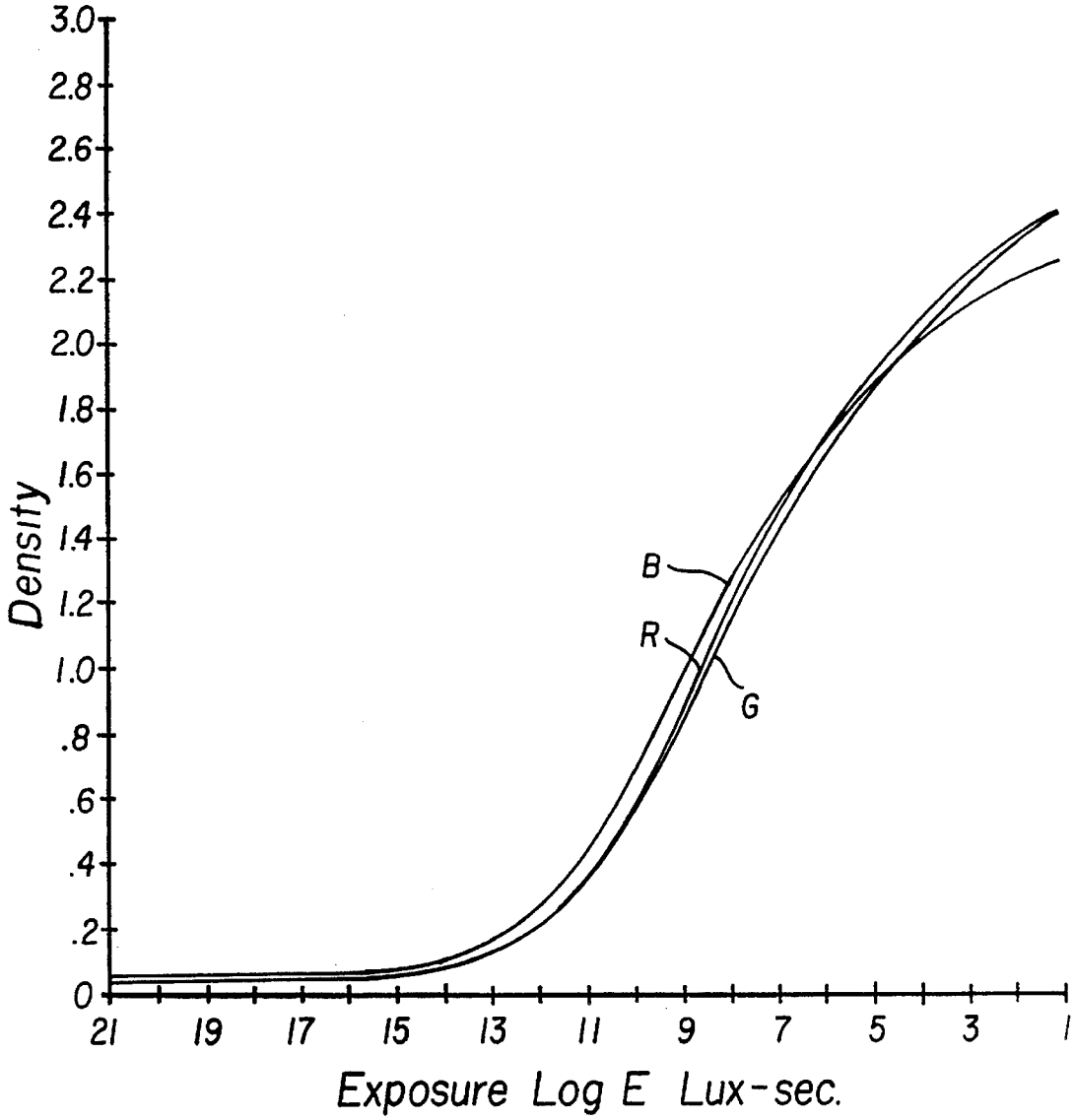
Figure 8:
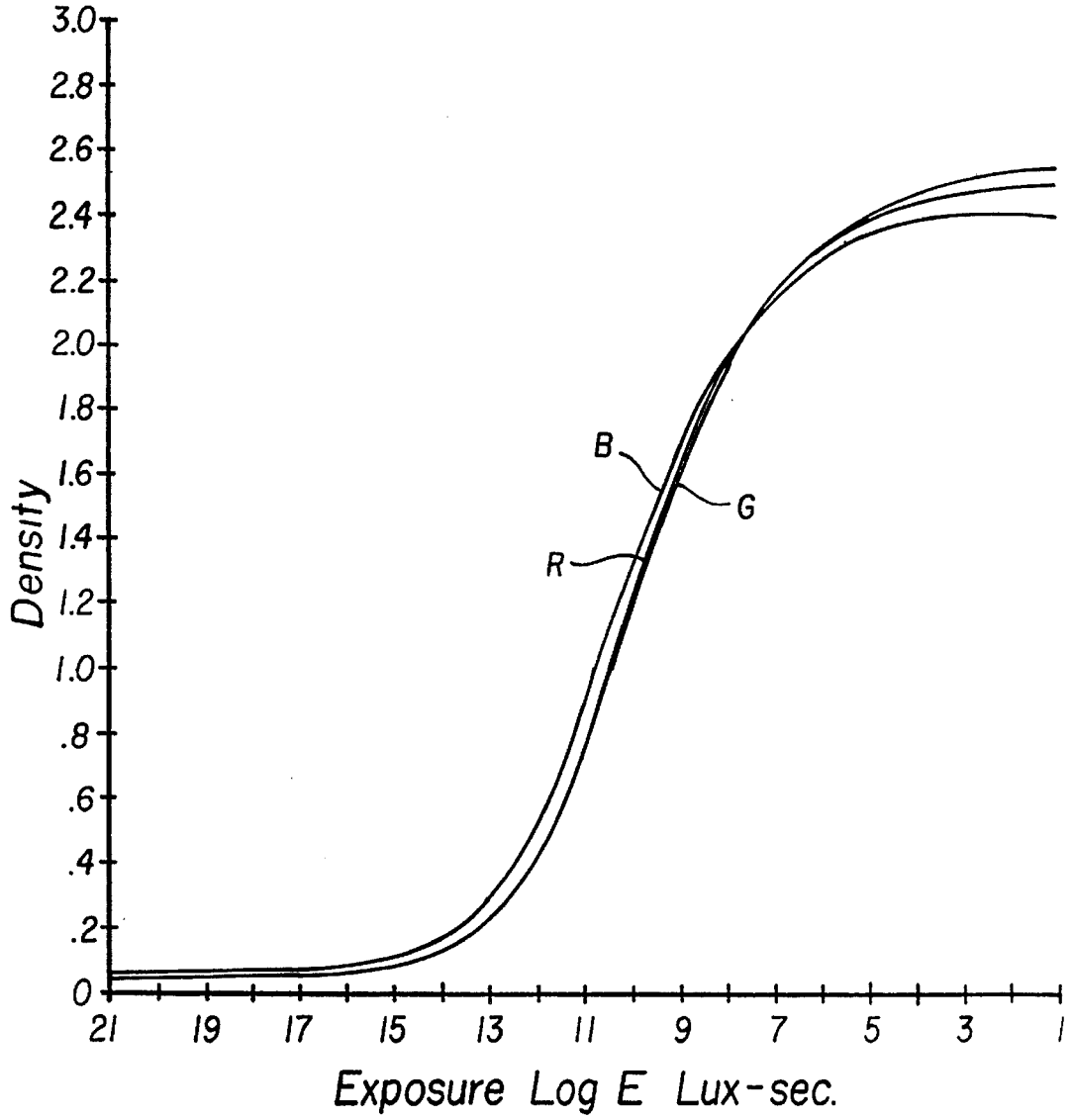
Figure 9:
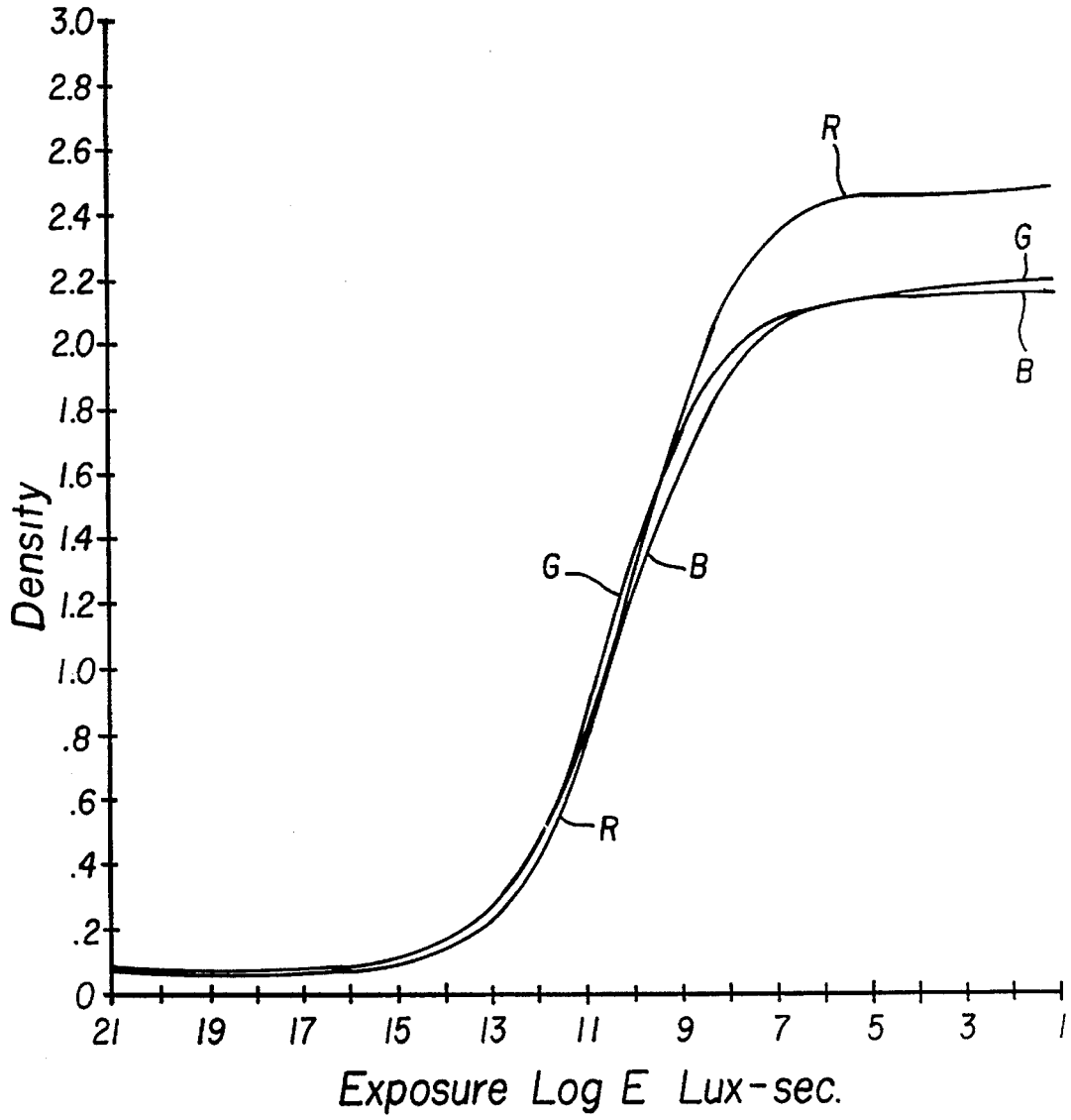
Figure 10:
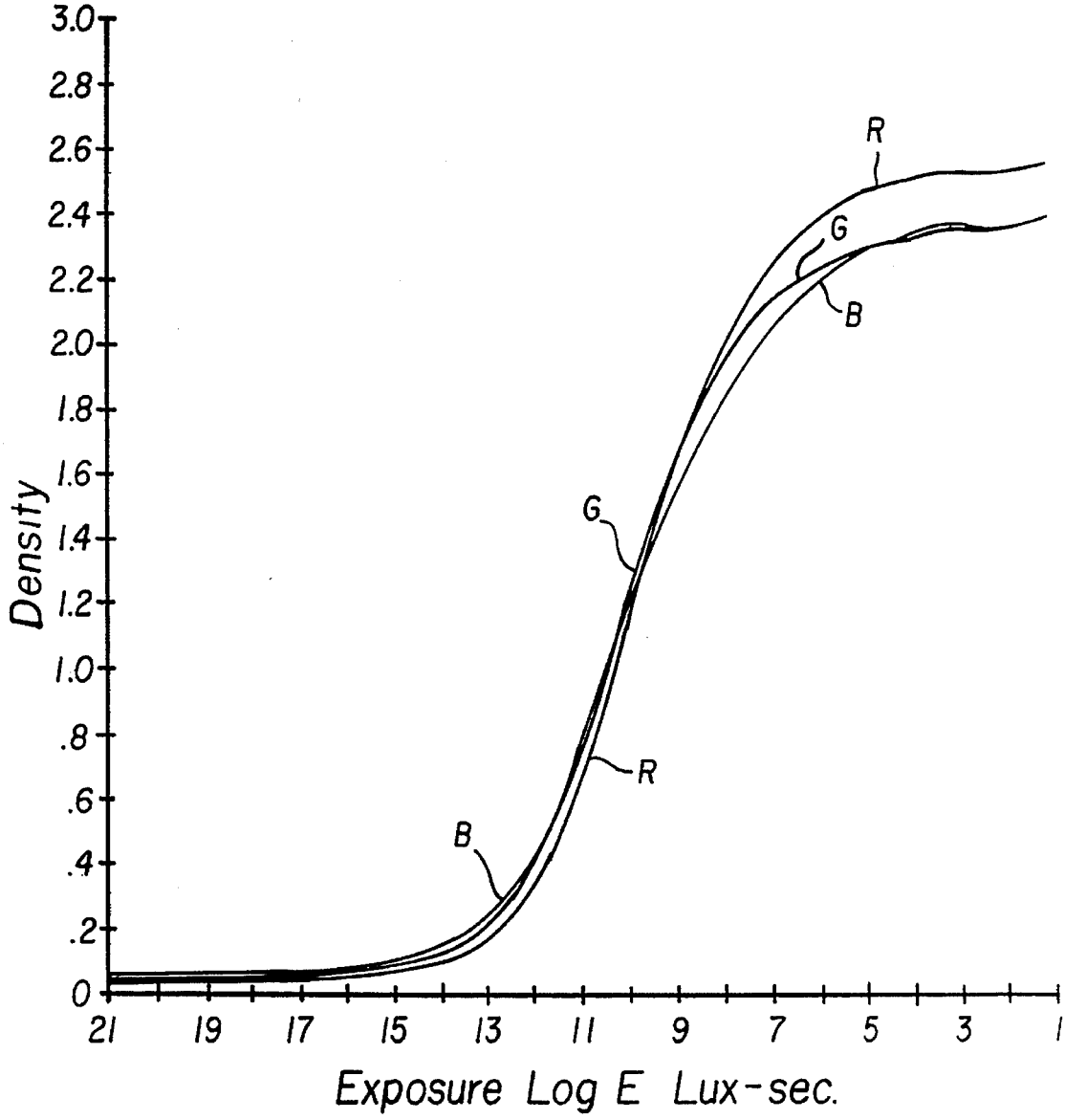
Figure 11:
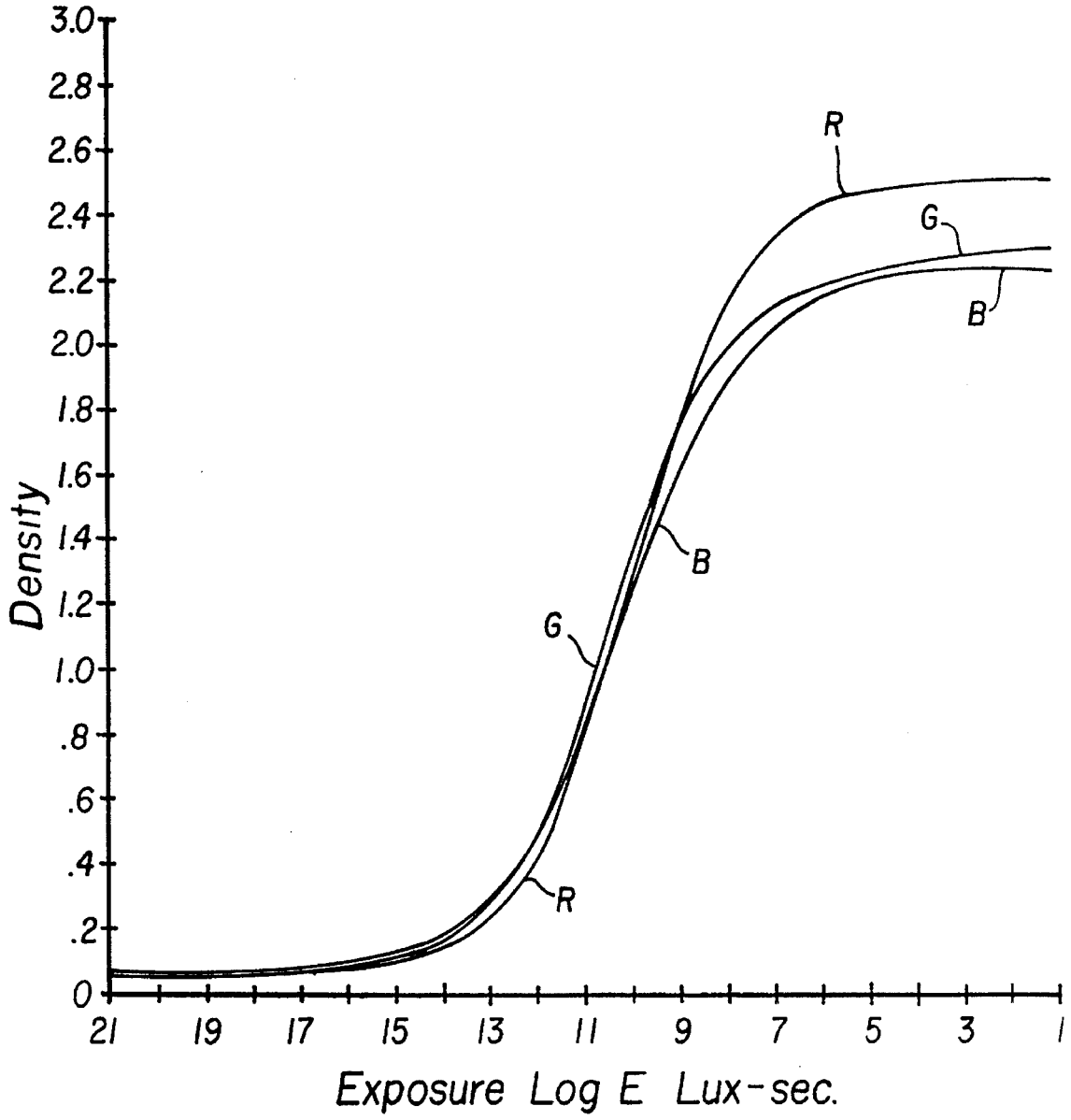
Figure 12:
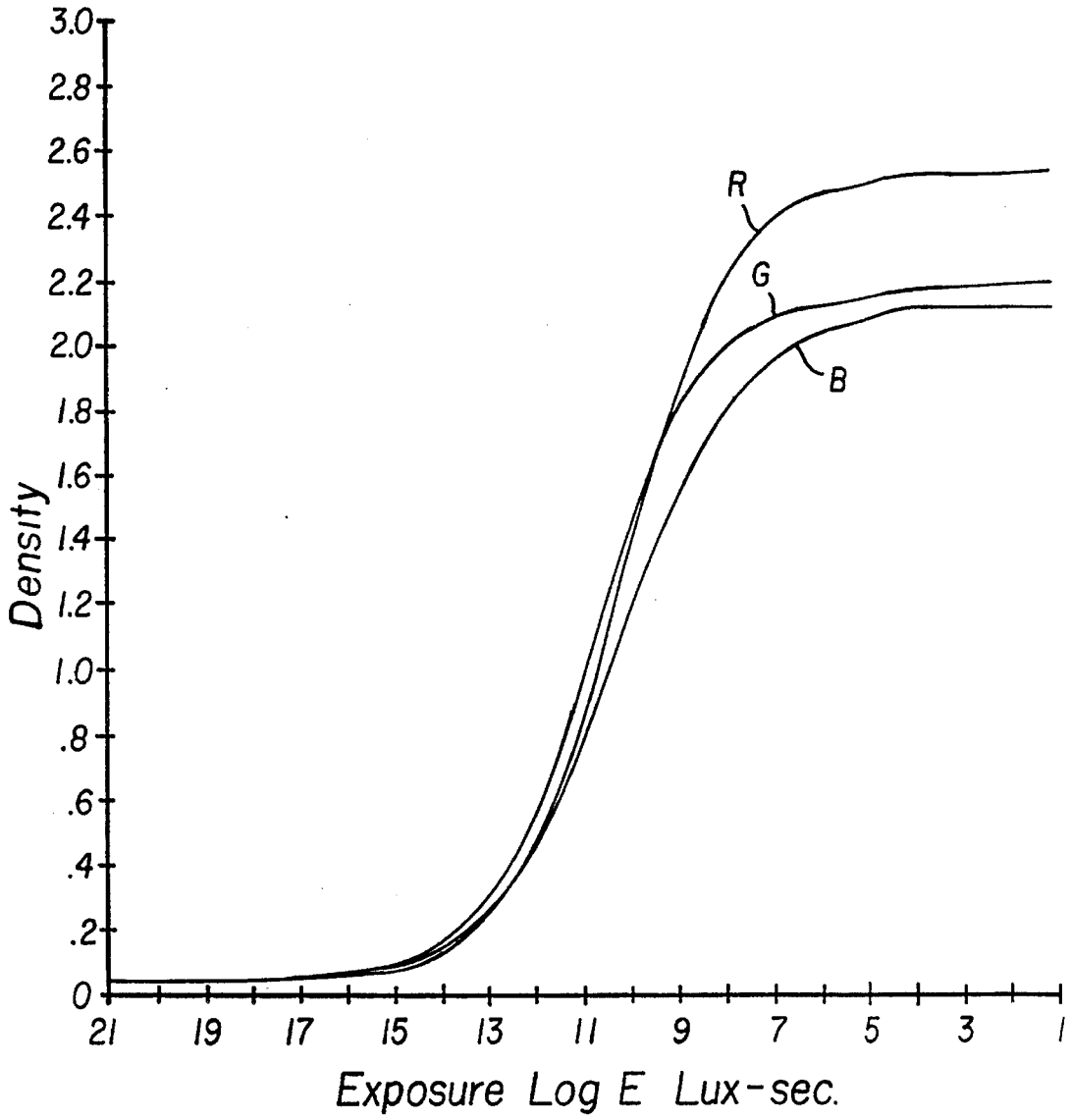
Figure 13:
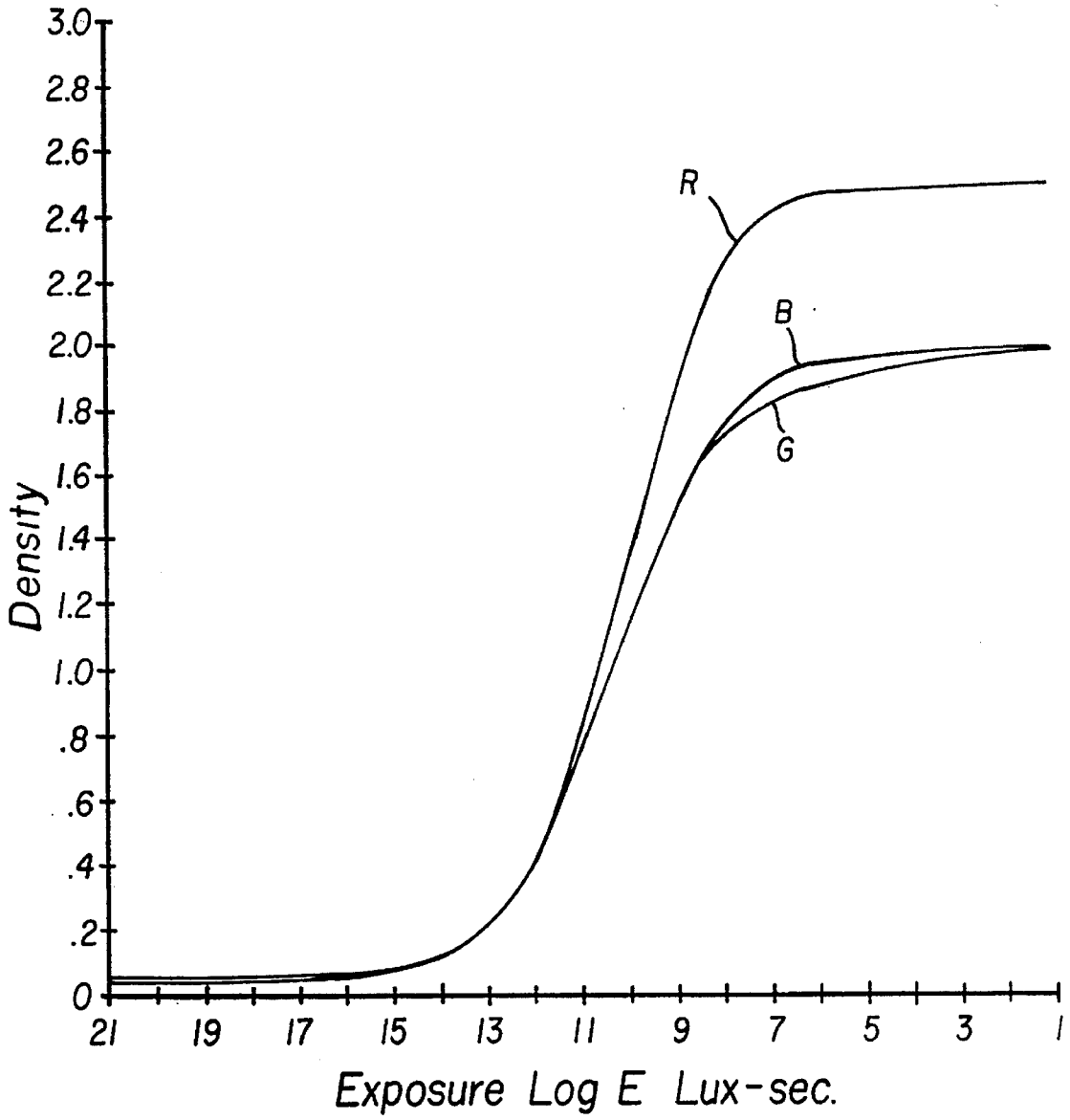

In a similar manner, two other photographic elements were prepared in which the blue spectrally sensitized silver chlorobromide (99:1) emulsion was replaced by a green spectrally sensitized, sulfur and gold chemically sensitized silver chlorobromide (75:25) emulsion, 0.15 micron, 818.1 mg/m$^2$ or a red spectrally sensitized, sulfur and gold chemically sensitized silver chlorobromide (75:25) emulsion, 0.15 micron, 818.1 mg/m$^2$. These elements were exposed and processed and the optical density measured as described in Example 1. The graphs of the characteristic curves for the elements containing the blue, green, and red spectrally sensitized emulsions are shown in FIGS. 6–8, respectively. It is clear from these graphs that elements containing this dispersion formulation and silver chlorobromide emulsions having a low bromide ion content (99:1) or a relatively high bromide ion content (75:25) give neutral images when processed in Process ECP-2B.

EXAMPLE 5: (Invention)

This example demonstrates that five other 3-coupler combinations (using G as the cyan coupler, K as the yellow coupler and magenta couplers M, N, O, P, and Q) where good neutral images are formed when elements containing these dispersions and a red spectrally sensitized, sulfur and gold chemically sensitized silver chlorobromide (75:25) emulsion are processed in Process ECP-2B. These also represent cases where the reactivities of the cyan (Formula II), magenta (Formula III), and yellow (Formula I) couplers are fairly well matched.

The oil phases of the 3-coupler dispersions are composed of mixtures of:

| magenta coupler: | Disp. A M | Disp. B N | Disp. C O | Disp. D P | Disp. E Q |
|---|---|---|---|---|---|
| Cyan Coupler G | 53.6g | 47.3g | 54.7g | 56.4g | 56.4g |
| Magenta Coupler (M–Q) | 32.9g | 35.3g | 29.3g | 28.6g | 32.1g |
| Yellow Coupler K | 72.1g | 75.3g | 74.7g | 73.6g | 70.0g |
| Coupler Solvent E | 81.4g | 81.3g | 81.3g | 81.4g | 81.4g |
| Auxiliary Solvent I | 320.0g | 320.0g | 320.0g | 320.0g | 320.0g |

The aqueous phase of the dispersions were composed of mixtures of:

| | | | | | |
|---|---|---|---|---|---|
| Gelatin | 130.0g | 130.0g | 130.0g | 130.0g | 130.0g |
| Alkanol-XC Surfactant | 12.0g | 12.0g | 12.0g | 12.0g | 12.0g |
| Water | 1298.0g | 1298.0g | 1298.0g | 1298.0g | 1298.0g |
| Total | 2000.0g | 2000.0g | 2000.0g | 2000.0g | 2000.0g |

The procedure for making these dispersions is identical to that described in Example 2. These dispersion were coated in a single layer format with the following structure:

Coatings 5–9

Protective Overcoat Layer:

Poly(dimethyl siloxane), 65.9 mg/m$^2$
Poly(dimethyl methacrylate) beads, 5.0 mg/m$^2$
Gelatin, 1001 mg/m$^2$
Spreading aids
Gel hardener Emulsion Layer:

Sulfur and gold sensitized silver chlorobromide (75:25) emulsion, 0.15 micron, spectrally sensitized with a red dye, 818.1 mg/m$^2$.
Gelatin, 3229 mg/m$^2$
Cyan Coupler G (see coverage in table below)
Magenta Couplers M–Q (see coverage in table below)
Yellow Coupler K (see coverage in table below)

Gelatin Sub:

Gelatin, 4887 mg/m$^2$

Support:

Transparent Acetate Support with Rem Jet Backing

Table of Cyan, Magenta, and Yellow Coupler Coverages in Coatings 5–9 (Coverage in mg/m$^2$)

| | Coating 5 Disp. A | Coating 6 Disp. B | Coating 7 Disp. C | Coating 8 Disp. D | Coating 9 Disp. E |
|---|---|---|---|---|---|
| Cyan Coupler Coverage | 645.8 | 645.8 | 645.8 | 645.8 | 645.8 |
| Magenta Coupler Coverage | 396.4 | 492.0 | 345.9 | 327.5 | 367.6 |
| Yellow Coupler Coverage | 868.7 | 1028.1 | 881.9 | 942.7 | 801.5 |

These elements were exposed and processed and the optical density measured as described in Example 1. The graphs of the characteristic curves for the elements containing the dispersion formulations described above using magenta couplers M, N, O, P, and Q are shown in FIGS. 9–13, respectively. It is clear from these graphs that elements containing dispersions A–E and silver chlorobromide (75:25) emulsions give relatively neutral images when processed in Process ECP-2B.

EXAMPLE 6: (Reactivity Ranking)

This example describes a test which demonstrates that two magenta couplers (L and Q) that form neutral images when combined with cyan coupler G and yellow coupler K are intermediate in reactivity between magenta couplers H (high reactivity) and J (low reactivity):

The oil phases of four magenta coupler dispersions are composed of a mixture of:

| | |
|---|---|
| Magenta Coupler H, J, L, or Q | 160.0 g |
| Coupler Solvent E | 80.0 g |
| Auxiliary Solvent I | 320.0 g |

The aqueous phases of the dispersions are composed of a mixture of:

| | |
|---|---|
| Gelatin | 130.0 g |
| Alkanol-XC Surfactant | 12.0 g |
| Water | 1298.0 g |

The procedure for making these dispersions was identical to that described in Example 2. These dispersions were coated in a single layer format with the following structure:

Coatings 10–13

Protective Overcoat Layer:

Poly(dimethyl siloxane), 65.9 mg/m$^2$
Poly(dimethyl methacrylate) beads, 5.0 mg/m$^2$
Gelatin, 1001 mg/m$^2$
Spreading aids
Gel hardener Emulsion Layer:

Sulfur and gold sensitized silver chlorobromide (75:25) emulsion, 0.15 micron, spectrally sensitized with a green dye, 484.4 mg/m$^2$.
Gelatin, 1916 mg/m$^2$
Magenta Coupler J (673.5 mg/m$^2$) or H (678.1 mg/m$^2$) or Q (812.1 mg/m$^2$) or L (686.5 mg/m$^2$)

Gelatin Sub:

Gelatin, 4887 mg/m$^2$

-continued

| Coatings 10–13 |
|---|
| Support: |
| Transparent Acetate Support with Rem Jet Backing |

The elements were exposed, processed, and the optical density due to dye formation was measured as described in Example 1 with the exception that the exposure time was 1/100 sec. The characteristic G curves from these elements are superimposed on FIG. 14. Fixed upper scale contrast (FUSC) values are defined as the slope of a line drawn between a point at a density of 1.0 and a point at 0.5 log E higher exposure. FUSC values were calculated from the curves shown in FIG. 14. These values were converted into relative fixed upper scale contrast values by dividing each FUSC value by the FUSC value calculated for magenta coupler J. This assigns a relative FUSC value of 1.00 to coupler J and a relative FUSC value of 2.00 to coupler H. Both FUSC and relative FUSC values are shown in the table below:

| Coupler | FUSC | Relative FUSC |
|---|---|---|
| J | 1.42 | 1.00 |
| H | 2.84 | 2.00 |
| Q | 2.19 | 1.54 |
| L | 2.32 | 1.63 |

To determine whether a magenta coupler falls within the scope of this invention, it must be evaluated along with couplers J and H according to the test described above, and its relative FUSC value needs to be normalized according to criteria that require coupler J to have a relative FUSC of 1.00 and coupler H to have a relative FUSC of 2.00.

Figure 14:
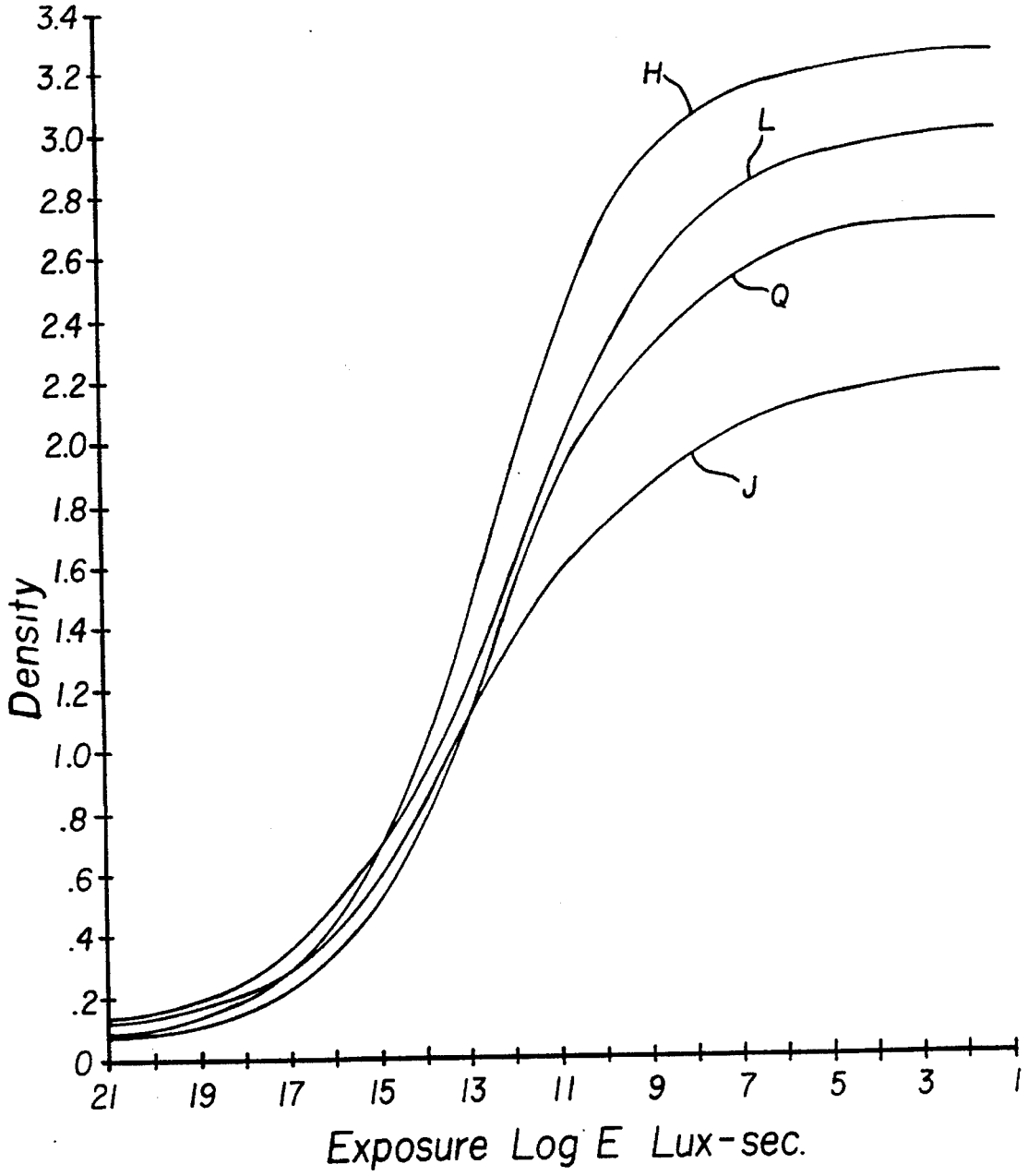

It is clear from the above table and FIG. 14 that couplers Q and L have relative FUSC values intermediate between that of H and J. Furthermore, all magenta couplers that are evaluated as described by this test that have relative FUSC values between 1.1 and 1.8 are expected to give reasonably close neutral images when elements containing a dispersion of one of these magenta couplers together with cyan coupler G and yellow coupler K, and a silver chlorobromide emulsion of low bromide (i.e., 99:1) content or high bromide (75:25) content are processed in Process ECP-2B.

EXAMPLE 7: (Invention)

This example demonstrates that three 3-coupler combinations (using a Formula IV coupler as the cyan coupler, a highly reactive magenta coupler H, and C as the yellow coupler) where good neutral images are formed when elements containing these dispersions and a red spectrally sensitized, sulfur and gold chemically sensitized silver chlorobromide (75:25) emulsion are processed in Process ECP-2B. These represent cases where the reactivites of the cyan, magenta, and yellow couplers are fairly well matched.

The oil phases of the 3-coupler dispersions are composed of mixtures of:

| cyan coupler: | Disp. A R | Disp. B S | Disp. C T |
|---|---|---|---|
| Cyan Coupler R–T | 75.4g | 75.4g | 86.2g |
| Magenta Coupler H | 31.2g | 31.2g | 37.0g |
| Yellow Coupler C | 64.6g | 64.6g | 48.0g |
| Coupler solvent E | 68.9g | 68.9g | 68.9g |
| Auxiliary Solvent I | 320.0g | 320.0g | 320.0g |

The aqueous phase of the dispersions were composed of mixtures of:

| | | | |
|---|---|---|---|
| Gelatin | 130.0 g | 130.0 g | 130.0 g |
| Alkanol-XC Surfactant | 12.0 g | 12.0 g | 12.0 g |
| Water | 1298.0 g | 1298.0 g | 1298.0 g |
| Total | 2000.0 g | 2000.0 g | 2000.0 g |

The procedure for making these dispersions is identical to that described in Example 2. These dispersions were coated in a single layer format with the following structure:

| Coatings 1–3 |
|---|
| Protective Overcoat Layer: |
| Poly(dimethyl siloxane), 65.9 mg/m$^2$ |
| Poly(dimethyl methacrylate) beads, 5.0 mg/m$^2$ |
| Gelatin, 1001 mg/m$^2$ |
| Spreading aids |
| Gel hardener |
| Emulsion Layer: |
| Sulfur and gold sensitized silver chlorobromide (75:25) emulsion, 0.5 micron, spectrally sensitized with a red dye, 818.1 mg/m$^2$. |
| Gelatin, 3229 mg/m$^2$ |
| Cyan Coupler R, S, or T (see coverage in table below) |
| Magenta Coupler H (see coverage in table below) |
| Yellow Coupler C (see coverage in table below) |
| Gelatin Sub: |
| Gelatin, 4887 mg/m$^2$ |
| Support: |
| Transparent Acetate Support with Rem Jet Backing |

Table of Cyan, Magenta, and Yellow Coupler Coverages in Coatings 1–3 of Example 7 (Coverage in mg/m$^2$)

| | Example 7 Coating 1 Disp. A | Example 7 Coating 2 Disp. B | Example 7 Coating 3 Disp. C |
|---|---|---|---|
| Cyan Coupler Coverage | 645.8 | 645.8 | 645.8 |
| Magenta Coupler Coverage | 267.4 | 267.4 | 277.0 |
| Yellow Coupler Coverage | 553.2 | 553.2 | 359.8 |

Figure 15:
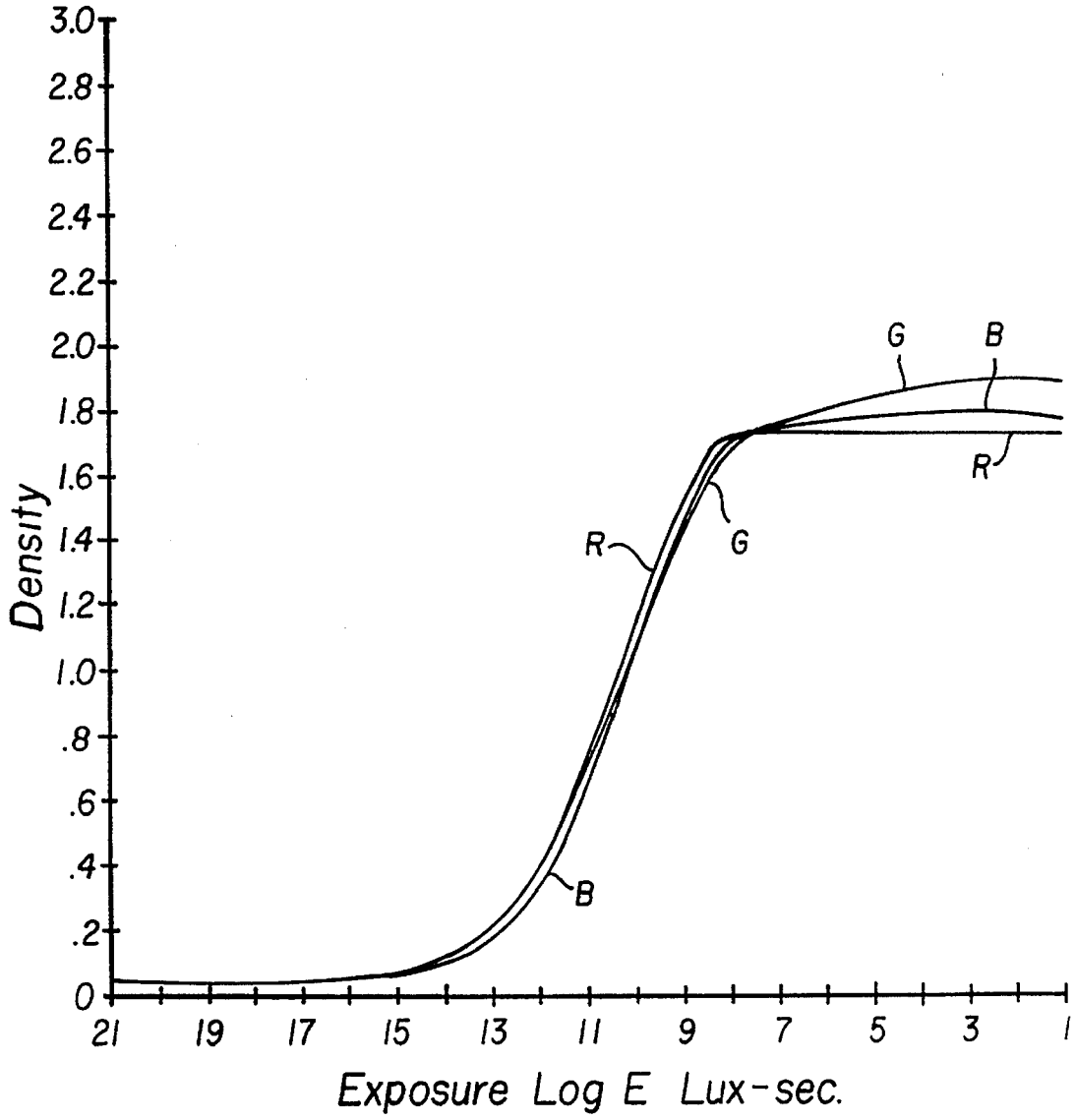
Figure 16:
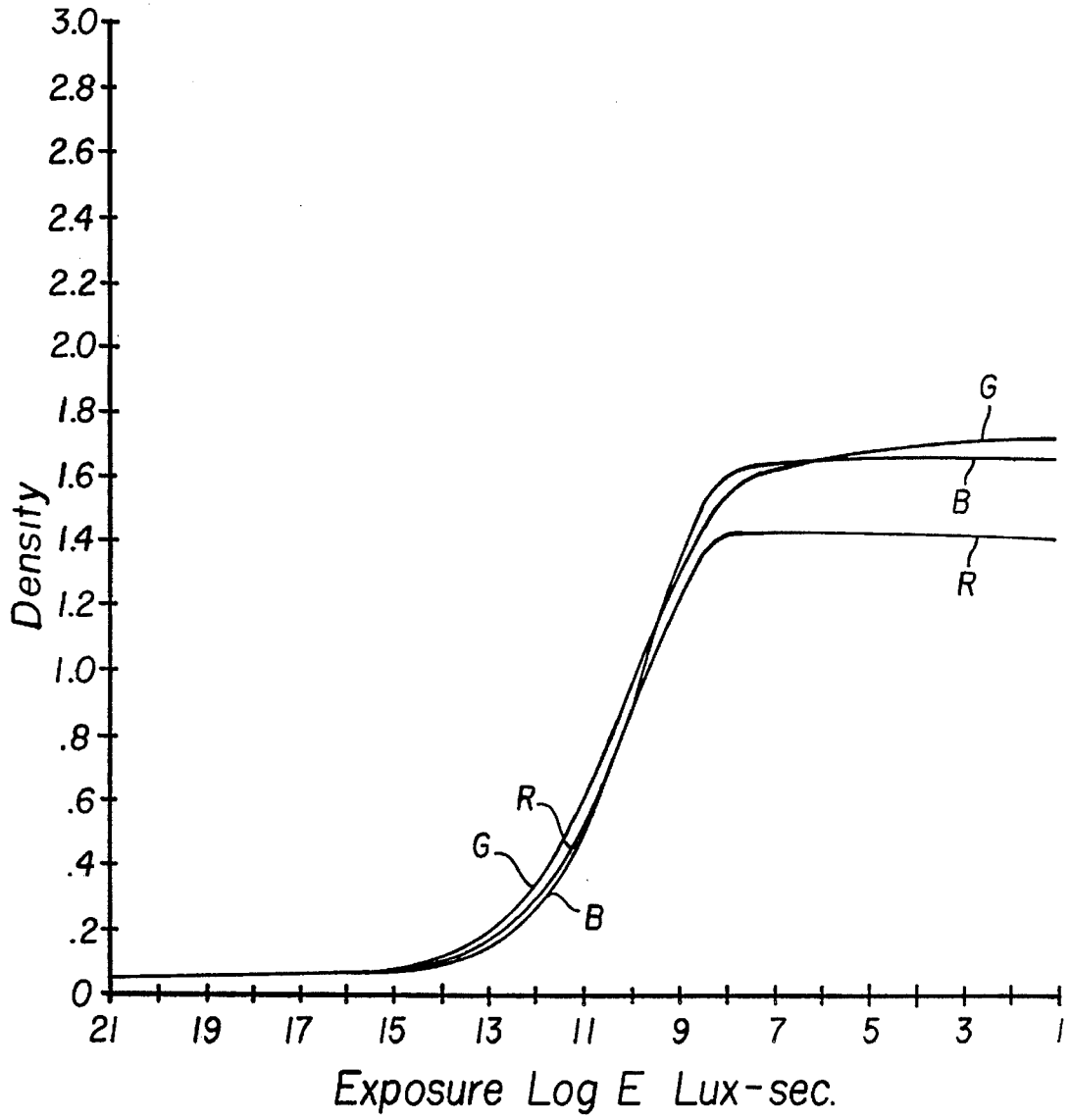
Figure 17:
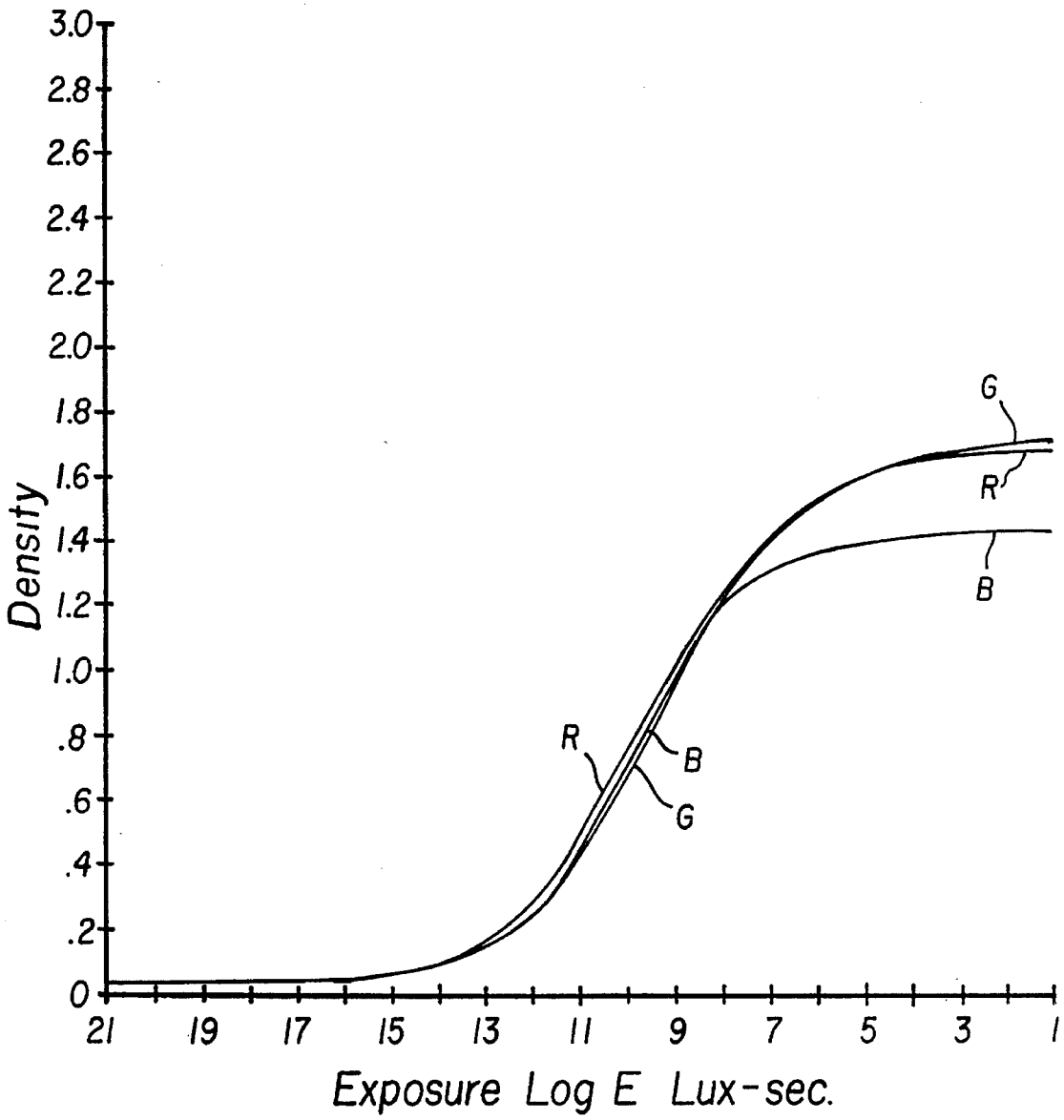
Figure 18:
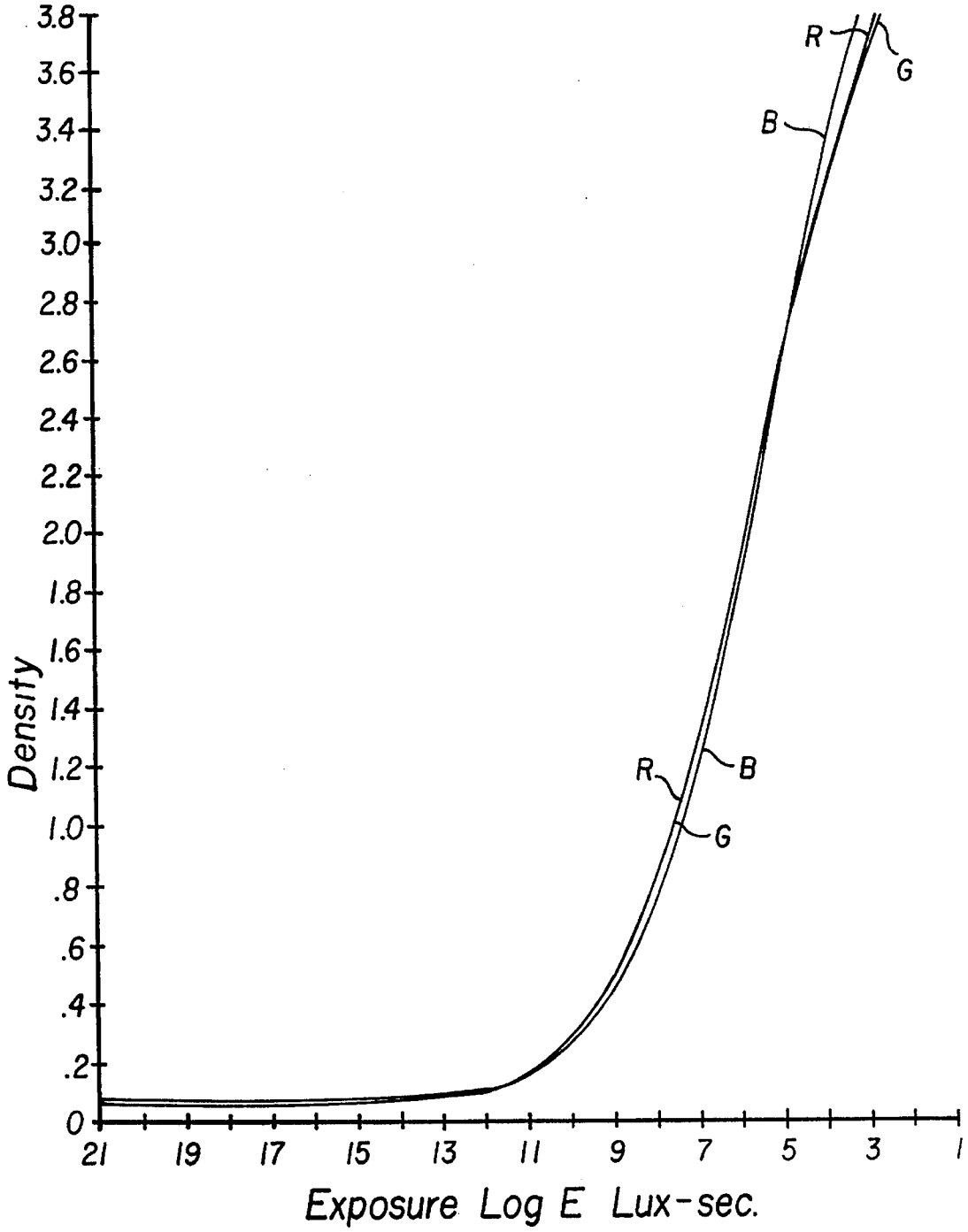
Figure 19:
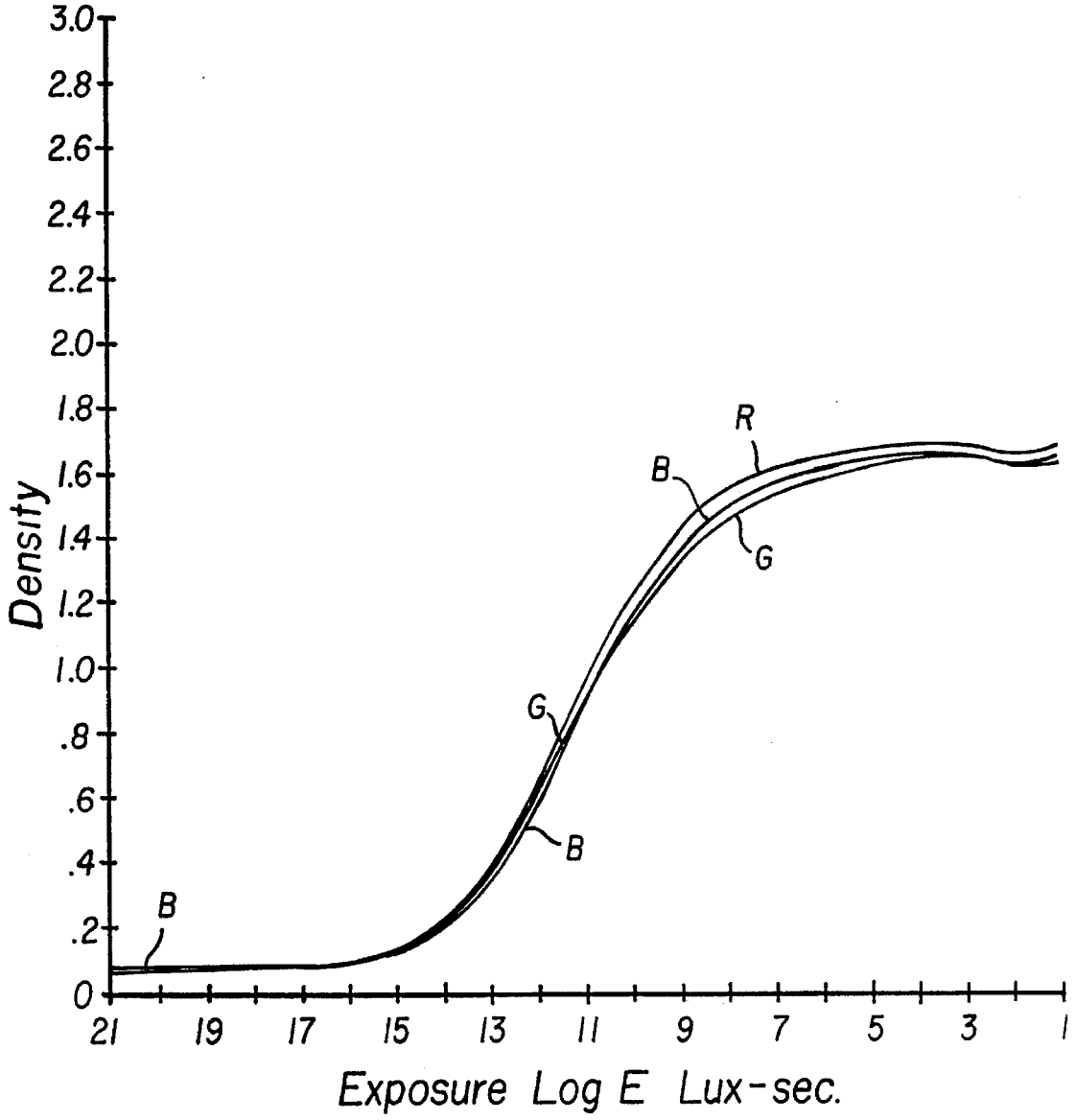
Figure 20:
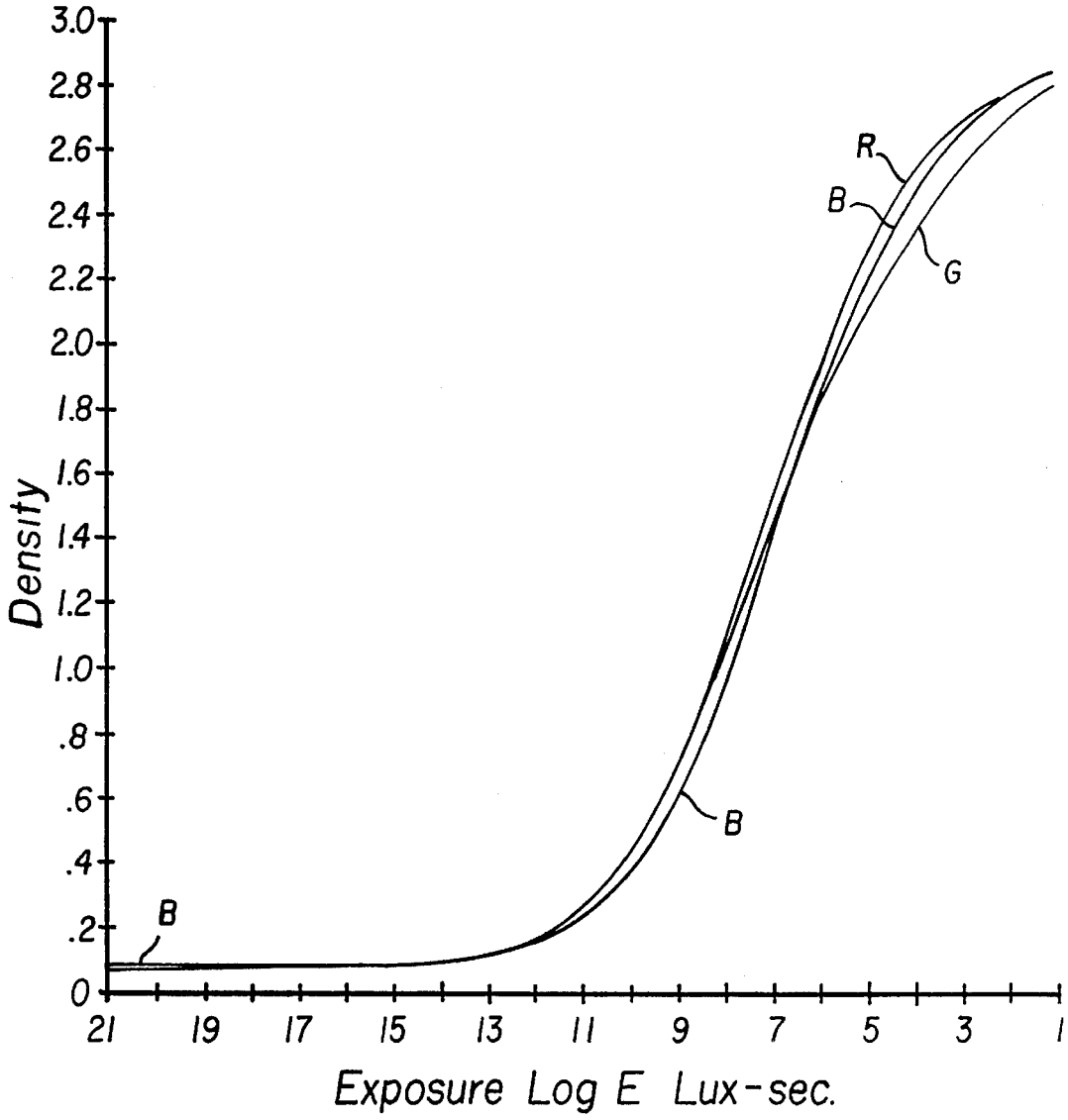
Figure 21:
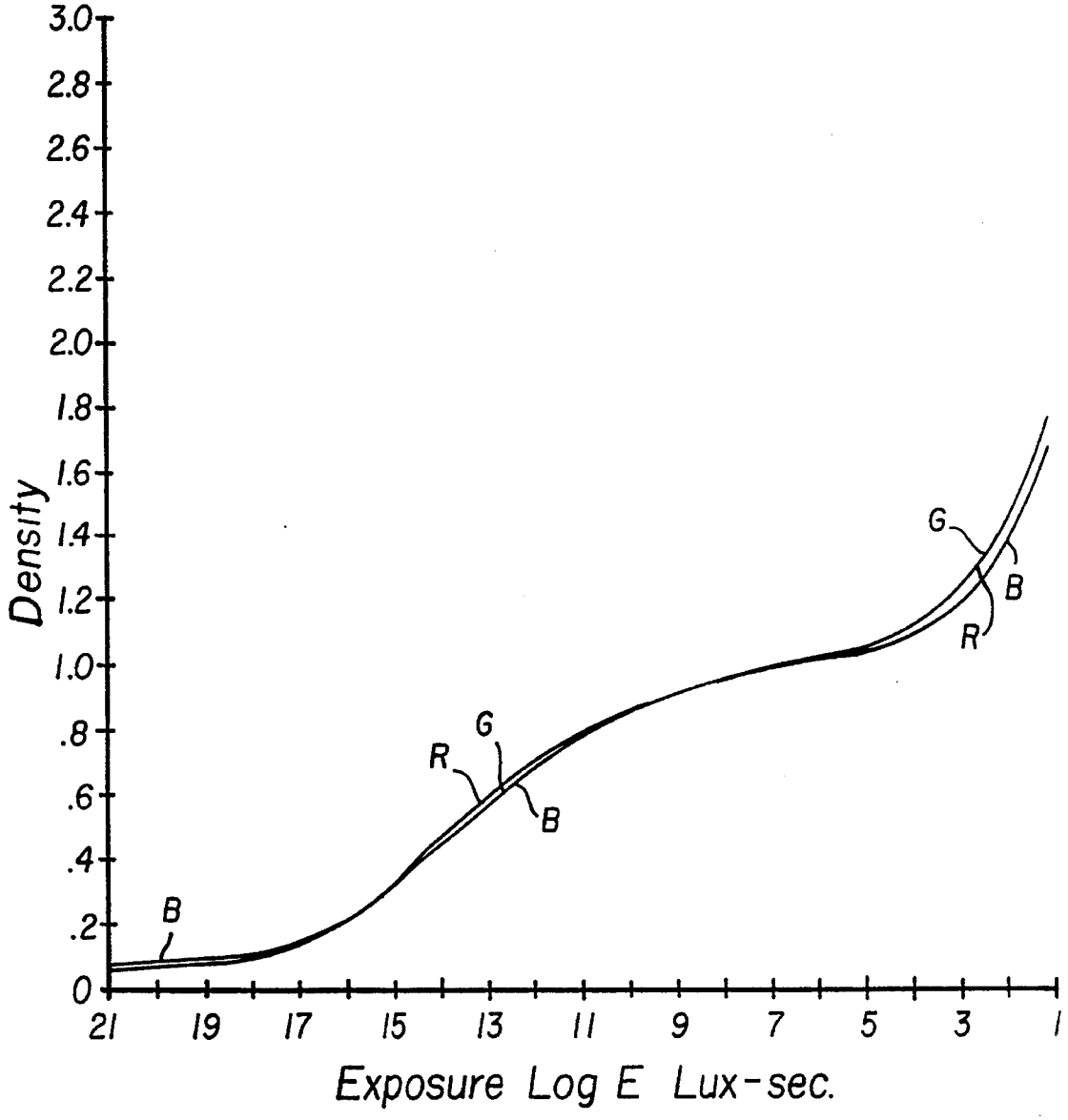

These elements were exposed and processed and the optical density measured as described in Example 1. The graphs of the characteristic curves for the elements containing the dispersion formulations described above using a Formula IV class cyan coupler and Formula I class yellow coupler in combination with a reactive Formula III class coupler are shown in FIGS. 15–17. It is clear from these graphs that elements containing dispersions A–C and silver chlorobromide (75:25) emulsions give neutral images when processed in Process ECP-2B.

EXAMPLE 8: (Invention)

An example of a multilayer element which contains a R/H/C dispersion formulation in combination with a blue sensitized silver chlorobromide (99:1) emulsion, a red sensitized silver chlorobromide (75:25) emulsion, and a green sensitized silver chlorobromide (75:25) emulsion. This element gives a neutral image when exposed to red, green, blue, or white light.

The oil phase of the 3-coupler dispersion is composed of a mixture of:

| | Disp. D |
|---|---|
| Cyan Coupler R | 76.5g |
| Magenta Coupler H | 28.8g |
| Yellow Coupler C | 65.8g |
| Coupler solvent E | 68.9g |
| Auxiliary Solvent I | 320.0g |

The aqueous phase of the dispersion is composed of a mixture of:

| | |
|---|---|
| Gelatin | 130.0g |
| Alkanol-XC Surfactant | 12.0g |
| Water | 1298.0g |
| Total | 2000.0g |

The procedure for making this dispersion is identical to that described in Example 2. This dispersion was coated in a multilayer format with the following structure:

Coating 4

Protective Overcoat Layer:

Poly(dimethyl siloxane), 65.9 mg/m$^2$
Poly(dimethyl methacrylate) beads, 5.0 mg/m$^2$
Gelatin, 1001 mg/m$^2$
Spreading aids
Gel hardener Green Sensitized Layer:

Sulfur and gold sensitized silver chlorobromide (75:25) emulsion, 0.15 micron, spectrally sensitized with a green dye, 1033.3 mg/m$^2$.
Gelatin, 4306 mg/m$^2$
Cyan Coupler R, 1141.0 mg/m$^2$
Magenta Coupler H, 429.6 mg/m$^2$
Yellow Coupler C, 981.4 mg/m$^2$ Red Sensitized Layer:

Sulfur and gold sensitized silver chlorobromide (75:25) emulsion, 0.15 micron, spectrally sensitized with a red dye, 581.3 mg/m$^2$.
Gelatin, 2153 mg/m$^2$
Cyan Coupler R, 645.8 mg/m$^2$
Magenta Coupler H, 243.1 mg/m$^2$
Yellow Coupler C, 555.5 mg/m$^2$ Blue Sensitized Layer:

Sulfur and gold sensitized silver chlorobromide (99:1) emulsion, 0.58 micron, spectrally sensitized with a blue dye, 462.9 mg/m$^2$.
Gelatin, 2153 mg/m$^2$
Cyan Coupler R, 505.9 mg/m$^2$
Magenta Coupler H, 190.5 mg/m$^2$
Yellow Coupler C, 435.1 mg/m$^2$ Gelatin Sub:

Gelatin, 4827 mg/m$^2$

-continued

Coating 4

Support:

Transparent Acetate Support with Rem Jet Backing

This element was exposed in the following manner:

1. 1/500 second/3000 degree K Tungsten light/0.6 neutral density filter/0–3 neutral density step tablet/heat absorbing filter/filter designed to represent a motion picture color negative film—this represents a white light exposure.

2. 1/250 second/3000 degree K Tungsten light/Kodak Wratten Filter, No. 2.9/0–3 neutral density step tablet/heat absorbing filter/filter designed to represent a motion picture color negative film—this represents a red light exposure.

3. 1/100 second/3000 degree K Tungsten light/Kodak Wratten Filter, No. 99/0–3 neutral density step tablet/heat absorbing filter/filter designed to represent a motion picture color negative film—this represents a green light exposure.

4. 1/50 second/3000 degree K Tungsten light/Kodak Wratten Filter, No. 98/0–3 neutral density step tablet/heat absorbing filter/filter designed to represent a motion picture color negative film—this represents a blue light exposure.

The exposed elements were processed in Process ECP-2B and the optical density was measured as described in Example 1. The graphs of the characteristic curves from the white, red, green, and blue light exposed and processed elements are shown in FIGS. 18–21, respectively. It is clear from these graphs that a multilayer element containing red and green spectrally sensitized silver chlorobromide (75:25) emulsions and a blue spectrally sensitized silver chlorobromide (99:1) emulsion in combination with a R/H/C dispersion forms neutral images when exposed to white, red, green, or blue light and processed in Process ECP-2B.

EXAMPLE 9: (Invention)

This example demonstrates that a dispersion formulation containing cyan coupler U, magenta coupler L, and yellow coupler K provides an essentially neutral image when an element containing this dispersion and a red spectrally sensitized, sulfur and gold chemically sensitized silver chlorobromide (75:25) emulsion is processed in Process ECP-2B. This also represents a case where the reactivities of the cyan, magenta, and yellow couplers are well-matched:

The oil phase of the 3-coupler dispersion is composed of a mixture of:

| | |
|---|---|
| Cyan Coupler U | 58.3 g |
| Magenta Coupler L | 28.8 g |
| Yellow Coupler K | 71.3 g |
| Coupler Solvent E | 81.6 g |
| Auxiliary Solvent I | 320.0 g |

The aqueous phase of the dispersion is composed of a mixture of:

| | |
|---|---|
| Gelatin | 130.0 g |
| Alkanol-XC surfactant | 12.0 g |
| Water | 1298.0 g |
| Total | 2000.0 g |

The procedure for making this dispersion is identical to that described in Example 2. This dispersion was coated in a single layer format with the following structure:

Coating 15

Protective Overcoat Layer:

Poly(dimethyl siloxane), 65.9 mg/m$^2$
Poly(dimethylmethacrylate) beads, 5.0 mg/m$^2$
Gelatin, 1001 mg/m$^2$
Spreading aids
Gel hardener Emulsion Layer:

Sulfur and gold sensitized silver chlorobromide (99:1) emulsion, 0.15 micron, spectrally sensitized with a red dye, 818.1 mg/m$^2$.
Gelatin, 3229 mg/m$^2$
Cyan Coupler U, 645.8 mg/m$^2$
Magenta Coupler L, 319.0 mg/m$^2$
Yellow Coupler K, 789.9 mg/m$^2$ -continued Coating 15

Gelatin Sub:

Gelatin, 4887 mg/m$^2$

Support:

Transparent Acetate Support with Rem Jet Backing

Figure 22:
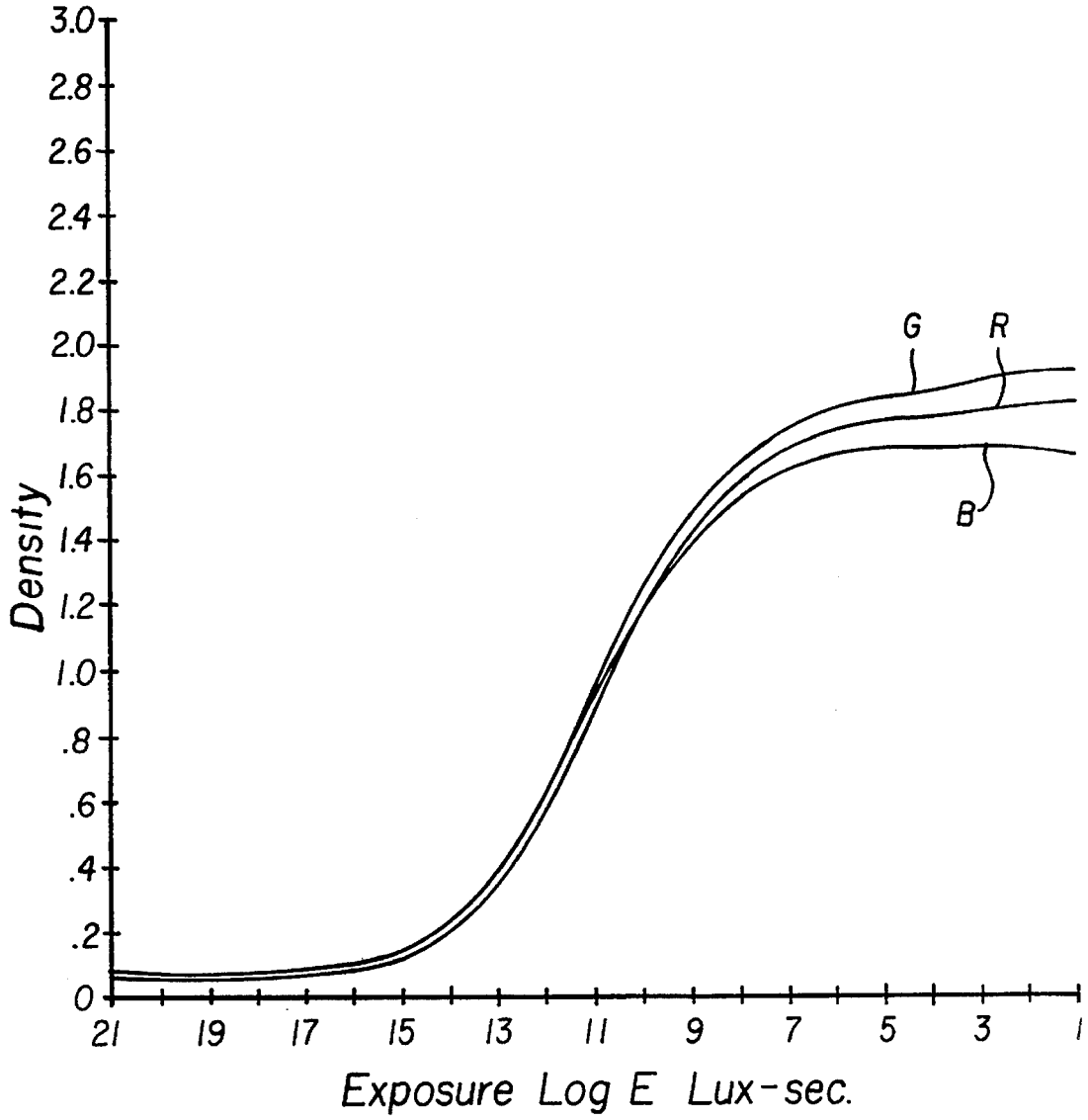

The element was exposed, processed, and the optical density due to dye formation was measured as described in Example 1. The characteristic curves are shown in FIG. 22. It is clear from this graph that the element containing this dispersion formulation and a silver chlorobromide (75:25) emulsion gives a neutral image when processed in Process ECP-2B.

APPENDIX

A

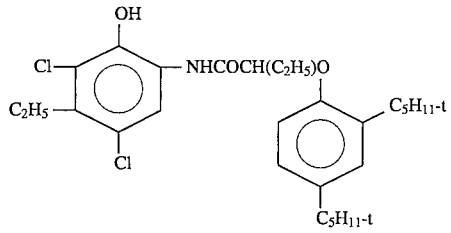

B

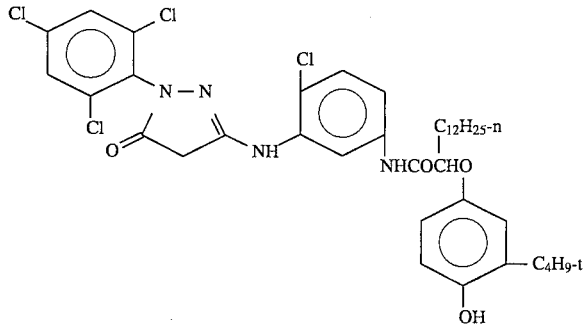

C

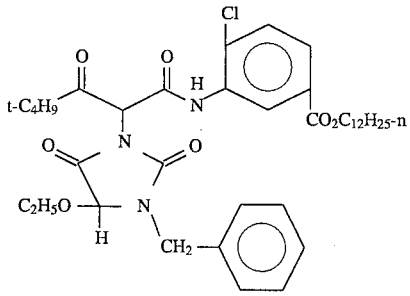

D

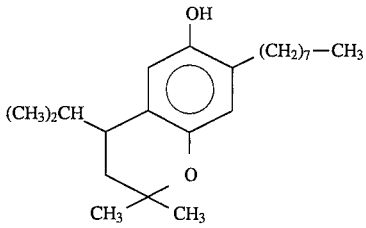

-continued
APPENDIX
E
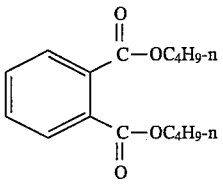
F
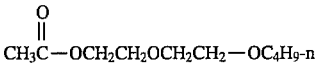
G
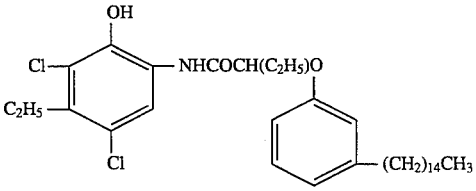
H
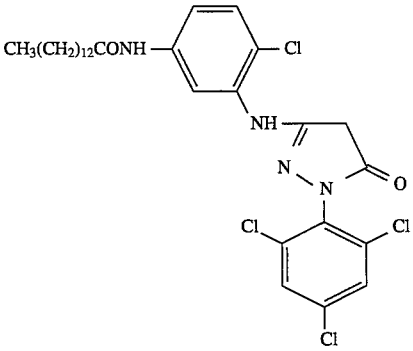
I
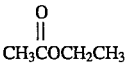
J
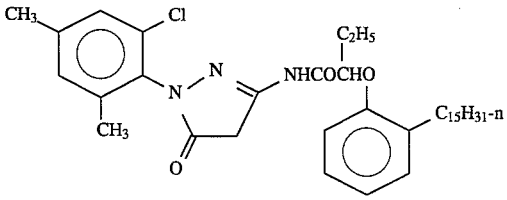
K
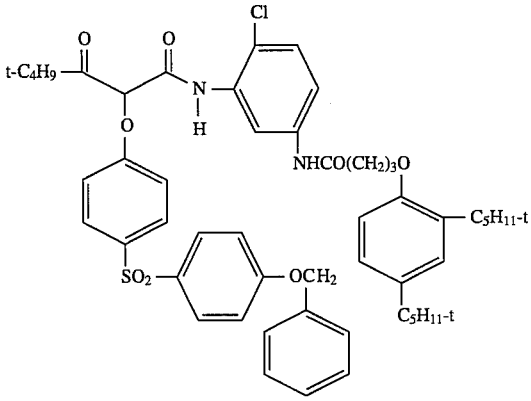

-continued
APPENDIX
L
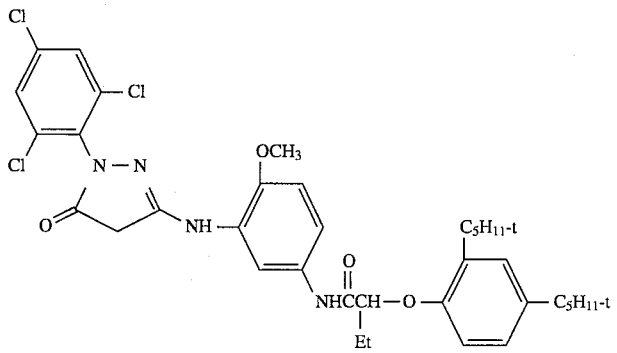
M
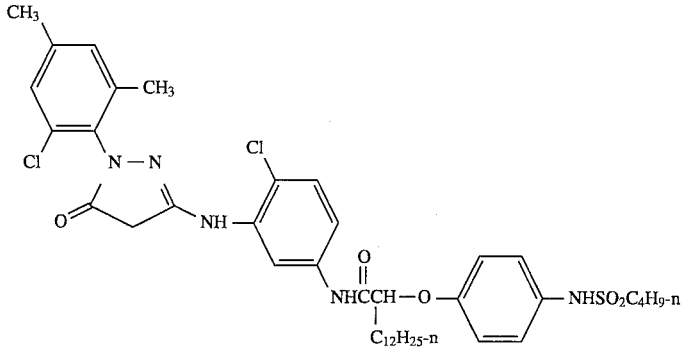
N
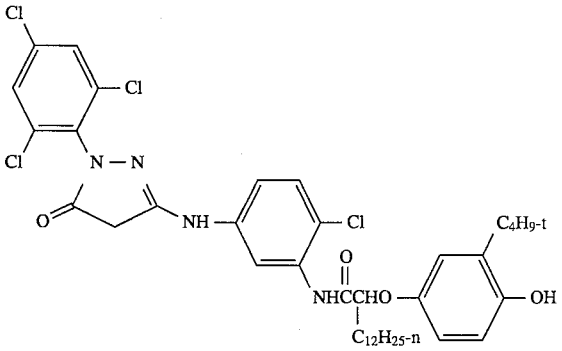
O
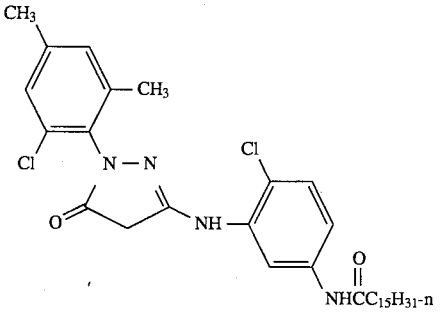

-continued
APPENDIX
P
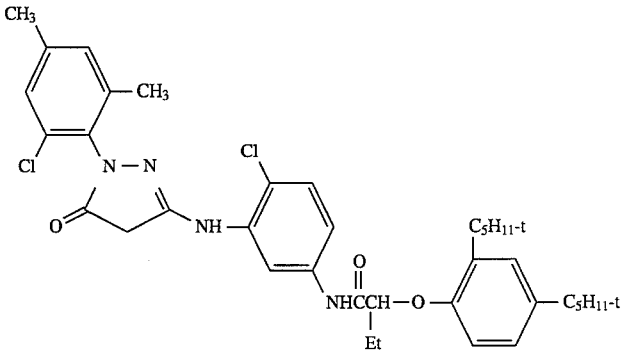
Q
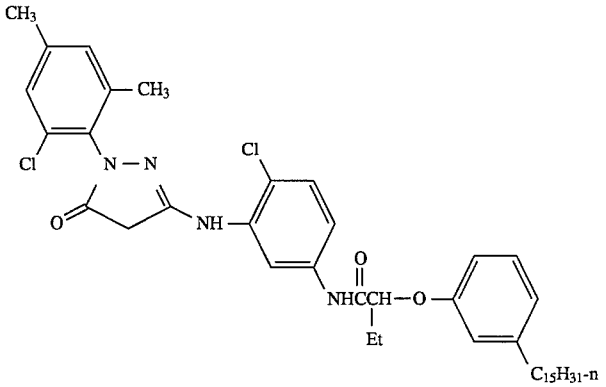
Alkanol-XC (Dupont)
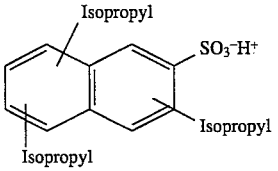
a mixture of predominantly di- and tri-substituted isomers
CD-2
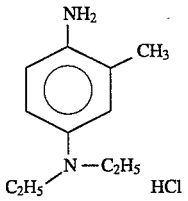
R
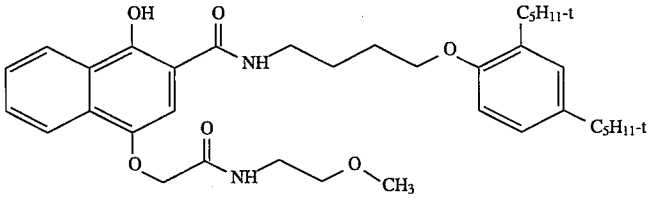

-continued

APPENDIX

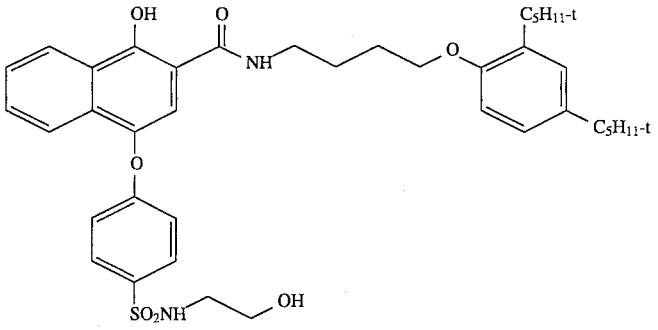

S

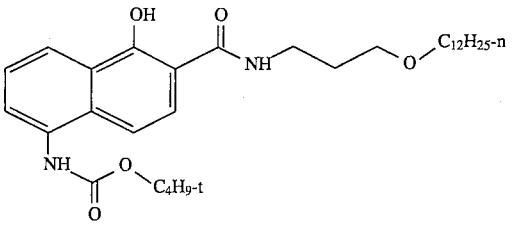

T

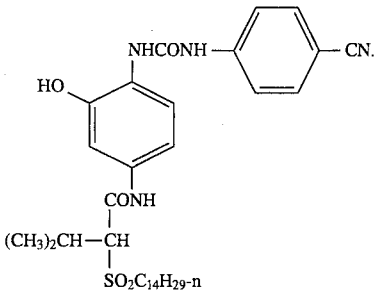

U

The invention has been described in detail with particular reference to preferred embodiments thereof, but it will be understood that variations and modifications can be effected within the spirit and scope of the invention.

We claim:

1. A photographic element for forming a neutral image comprising at least one layer comprising a photosensitive silver halide emulsion, a Formula I class yellow coupler comprising

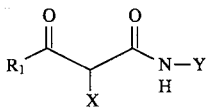

I wherein $R_1$ represents a substituent;

X is hydrogen or a coupling-off group;

Y represents an aryl group or a heterocyclic group;

a Formula II class cyan coupler comprising

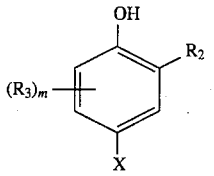

II wherein $R_2$ represents a substituent;

$R_3$ represents a substituent;

X represents a hydrogen or a coupling-off group;

m is from 1–3; and a Formula III class magenta coupler comprising

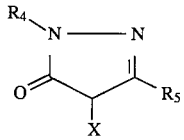

III wherein $R_4$ is a substituent;

$R_5$ is a substituent;

X is hydrogen or a coupling-off group;

and which provides a relative fixed upper scale contrast between about 1.1 and 1.8.

2. The element of claim 1 wherein the $R_1$ substituent represents an aryl or tertiary alkyl group.

3. The element of claim 1 wherein the $R_2$ substituent represents a carbamoyl, ureido, or carbonamido group.

4. The element of claim 1 wherein the $R_3$ substituent comprises a halogen, alkyl or carbonamido group.

5. The element of claim 1 wherein the $R_4$ substituent comprises an aryl group.

6. The element of claim 1 wherein the $R_5$ substituent comprises an anilino, carbonamido, ureido, carbamoyl, alkoxy, aryloxycarbonyl, or N-heterocyclic group.

7. The element of claim 1 wherein Formula I comprises

K
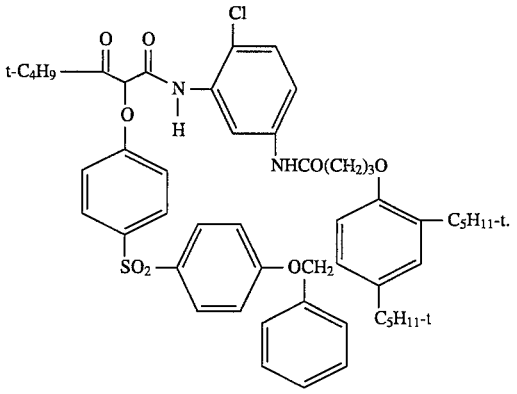
8. The element of claim 1 wherein Formula II comprises
G
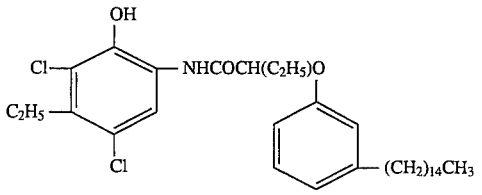
or
U
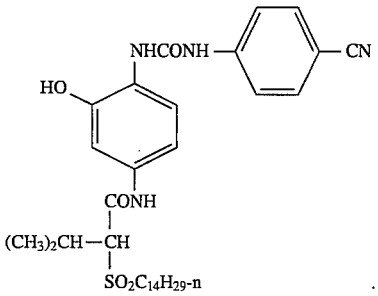
9. The element of claim 1 wherein Formula III is selected from the group consisting of
L
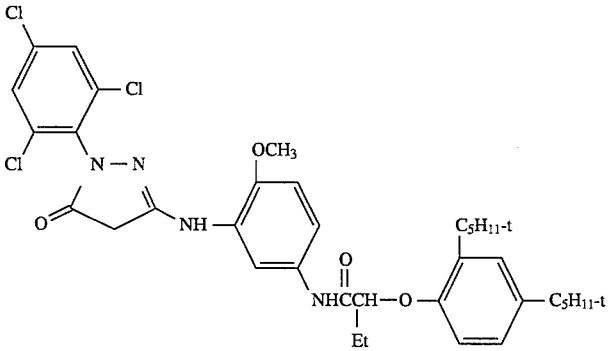
M
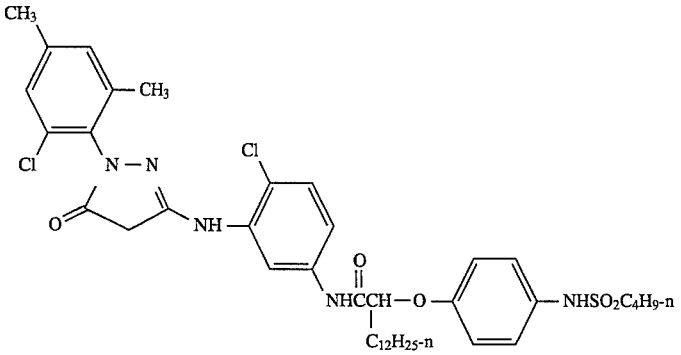
N
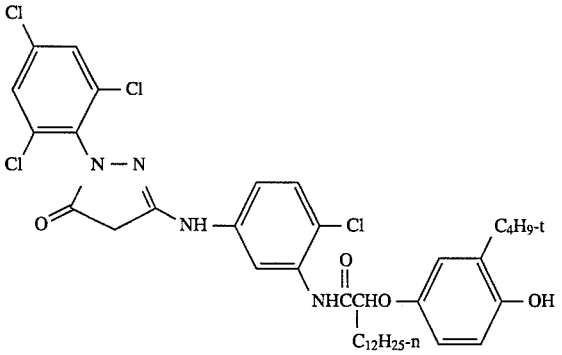

-continued

O

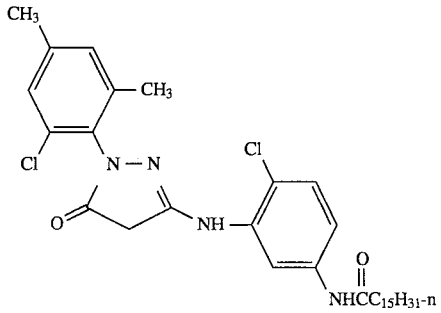

P

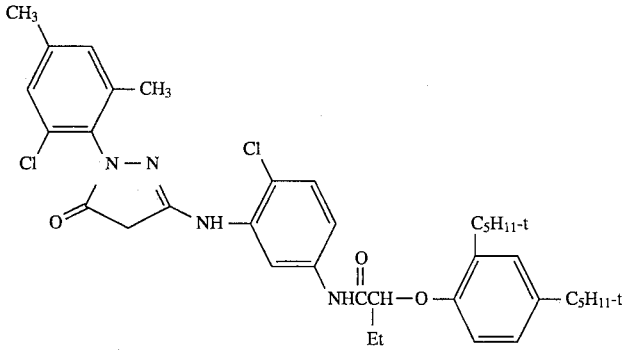

Q

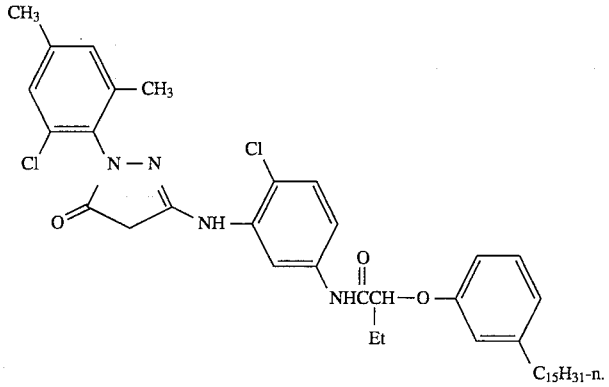

10. The element of claim 1 wherein said silver halide emulsion comprises a blue sensitive silver chlorobromide emulsion of between about 95 and 99 percent silver chloride.

11. The element of claim 1 wherein said silver halide emulsion comprises a red or green sensitive silver chlorobromide emulsion of between 65 and 85 percent silver chloride and 15 to 35 percent silver bromide.

12. The element of claim 10 wherein said silver chlorobromide has a grain size between about 0.4 and 0.8 microns.

13. The element of claim 11 wherein said silver chlorobromide has a grain size between about 0.1 and 0.3 microns.

* * * * *